US008013504B2

(12) United States Patent
Kameda et al.

(10) Patent No.: US 8,013,504 B2
(45) Date of Patent: Sep. 6, 2011

(54) SPARK PLUG FOR INTERNAL COMBUSTION ENGINE AND METHOD FOR PRODUCING THE SPARK PLUG

(75) Inventors: Hiroyuki Kameda, Aichi (JP); Katsutoshi Nakayama, Aichi (JP); Satoshi Nagasawa, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 255 days.

(21) Appl. No.: 12/274,828

(22) Filed: Nov. 20, 2008

(65) Prior Publication Data

US 2009/0140624 A1 Jun. 4, 2009

(30) Foreign Application Priority Data

Nov. 20, 2007 (JP) ..... P2007-300824
Dec. 28, 2007 (JP) ..... P2007-338712
May 2, 2008 (JP) ..... P2008-120065

(51) Int. Cl.
*H01T 13/20* (2006.01)

(52) U.S. Cl. ..... 313/141; 445/7

(58) Field of Classification Search ..... 313/118–145, 313/169 EL, 32, 41, 310; 123/143 R, 146.5 R, 123/169 R, 169 EL, 169 P, 260, 280
See application file for complete search history.

(56) References Cited

U.S. PATENT DOCUMENTS 4,700,103 A 10/1987 Yamaguchi et al.
5,488,262 A 1/1996 Takamura
5,574,329 A * 11/1996 Kagawa ..... 313/141
5,811,915 A * 9/1998 Abe et al. ..... 313/141
6,523,515 B2 2/2003 Kanao
6,707,237 B2 3/2004 Teramura et al.
6,720,716 B2 4/2004 Shibata et al.
6,724,132 B2 4/2004 Kanao
6,798,124 B2 9/2004 Hiramatsu
7,084,558 B2 8/2006 Teramura et al.
7,154,213 B2 12/2006 Nakamura et al.
7,321,187 B2 1/2008 Teramura et al.
2002/0021066 A1 2/2002 Kanao
2002/0093277 A1 7/2002 Hiramatsu
2002/0105254 A1* 8/2002 Hori et al. ..... 313/141
2004/0041506 A1 3/2004 Teramura et al.
2005/0062385 A1* 3/2005 Nakamura et al. ..... 313/141
2005/0218771 A1 10/2005 Hrastnik et al.
2006/0238092 A1 10/2006 Teramura et al.

(Continued)

FOREIGN PATENT DOCUMENTS

CN 2938494 Y 8/2007

(Continued)

*Primary Examiner* — Nimeshkumar D Patel
*Assistant Examiner* — Donald L Raleigh
(74) *Attorney, Agent, or Firm* — Sughrue Mion, PLLC

(57) ABSTRACT

A spark plug including: a center electrode; a substantially cylindrical insulator; a cylindrical metal shell; a ground electrode having a base end joined to a leading end portion of the metal shell and a distal end bent toward the axis line. The ground electrode includes: a thick portion provided on a base end side, a thin portion provided on a distal end side, and a stepped portion provided on an inner peripheral surface between the thick portion and the thin portion. A noble metal tip is joined to and partially embedded in the inner peripheral surface of the thin portion and disposed to form a gap between the noble metal tip and the leading end portion of the center electrode.

21 Claims, 18 Drawing Sheets

U.S. PATENT DOCUMENTS

| | | | | |
|---|---|---|---|---|
| 2006/0276097 | A1* | 12/2006 | Suzuki et al. | 445/7 |
| 2007/0114902 | A1 | 5/2007 | Suzuki | |
| 2008/0174221 | A1* | 7/2008 | Tinwell | 313/141 |

FOREIGN PATENT DOCUMENTS

| | | | |
|---|---|---|---|
| JP | 61-45583 | A | 3/1986 |
| JP | 5-101869 | A | 4/1993 |
| JP | 5-166577 | A | 7/1993 |
| JP | 5-198348 | A | 8/1993 |
| JP | 5-242952 | A | 9/1993 |
| JP | 11-185928 | A | 7/1999 |
| JP | 2001-351761 | A | 12/2001 |
| JP | 2002-83662 | A | 3/2002 |
| JP | 3273215 | B2 | 4/2002 |
| JP | 2002-289321 | A | 10/2002 |
| JP | 2002-324650 | A | 11/2002 |
| JP | 2004-127916 | A | 4/2004 |
| JP | 2004-259710 | A | 9/2004 |
| JP | 2005-100747 | A | 4/2005 |
| JP | 2005-294267 | A | 10/2005 |

* cited by examiner

SPARK PLUG FOR INTERNAL COMBUSTION ENGINE AND METHOD FOR PRODUCING THE SPARK PLUG

BACKGROUND OF THE INVENTION

1. Field of the Invention

The present invention relates to a spark plug for an internal combustion engine and a method for producing the spark plug.

2. Description of the Related Art

A spark plug used for an internal combustion engine, such as an automobile engine, includes a center electrode extended in the direction of an axis line, an insulator disposed radial outside the center electrode, a cylindrical metal shell disposed radial outside the insulator, and a ground electrode having a base end portion joined to a leading end surface of the metal shell. The ground electrode has a substantially rectangular shape in cross section, and the inner side surface of the distal end portion thereof is bent to face the leading end portion of the center electrode. As a result, a spark discharge gap is defined between the leading end portion of the center electrode and the distal end portion of the ground electrode.

In recent years, tips (noble metal tips) containing a noble metal alloy are joined to the leading end portion of the center electrode and the distal end portion of the ground electrode, respectively, for improving spark wear resistance. Additionally, in order to improve ignitability or spark propagation capability, a prism-shaped noble metal tip is welded to the ground electrode to protrude from a distal end surface of the ground electrode located on the axis-line side toward the axis line, and a spark discharge is performed between the noble metal tip and the outer periphery of the leading end portion of the center electrode (outer periphery of the noble metal tip for a center electrode) in a direction perpendicular to the direction of the axis line (see JP-A-61-45583, for example).

Such spark plug is generally produced by welding a noble metal tip for a ground electrode to a predetermined portion of the leading end portion of the straight rod-shaped ground electrode, and thereafter bending the ground electrode.

However, as described above, in a spark plug in which a spark discharge is performed in the direction perpendicular to the direction of the axis line, the bent portion of the ground electrode becomes tightened. In detail, in order to perform a spark discharge in the direction of the axis line, the ground electrode is formed so that its distal end portion reaches the axis line, and the ground electrode can easily be bent. In other words, it is not very difficult to make the distal end portion of the ground electrode straight. On the other hand, in order to perform a spark discharge in the direction perpendicular to the direction of the axis line, the distal end surface of the ground electrode is not allowed to reach the axis line. Therefore, a bent shape may still remains at the distal end portion of the ground electrode (i.e., it becomes difficult to make the distal end portion straight), or stresses caused by the bending will remain. If the spark plug is used while the residual stresses remains at the distal end portion of the ground electrode, the stress applied to the welded portion between the noble metal tip and the ground electrode may increase due to repetition of the cooling-heating cycle, and this may deteriorate a peel resistance of the noble metal tip.

Particularly, there is a need for a smaller diameter of spark plugs in recent years, and the diameter of the metal shell is also smaller, which may remarkably cause the above problem. In addition, when the diameter of the metal shell is small, not only in a type in which a spark discharge is performed in the direction perpendicular to the direction of the axis line, the above problem is also found in a type in which a spark discharge is performed in the direction of the axis line.

On the other hand, by increasing the curvature of the bent portion of the ground electrode (reducing the radius of curvature), the above problem is solved to some extent. However, in this case, strength at the bent portion cannot be secured, and another problem such as breakage of the bent portion may occur.

SUMMARY OF THE INVENTION

The present invention was made in consideration of the above circumstances, and an object thereof is to provide a spark plug for an internal combustion engine and a method for producing the same, which can prevent deterioration in peel resistance, etc., of a ground electrode due to the residual stresses caused by bending of a ground electrode.

A description will be hereinafter given of each aspect categorized to be suitable to solve the above-mentioned problems. The operations and effects unique to the corresponding aspects are added if necessary.

In a first aspect, the present invention provides a spark plug for an internal combustion engine, said spark plug comprising: a rod-shaped center electrode extending in the direction of an axis line; a substantially cylindrical insulator provided on an outer periphery of the center electrode; a cylindrical metal shell provided on an outer periphery of the insulator; a ground electrode having a base end joined to a leading end portion of the metal shell and a distal end bent toward the axis line, the ground electrode comprising: a thick portion provided on a base end side, a thin portion provided on a distal end side, and a stepped portion provided on an inner peripheral surface between the thick portion and the thin portion; a first noble metal tip joined to and partially embedded in the inner peripheral surface of the thin portion, the first noble metal tip being disposed to form a gap between the first noble metal tip and the leading end portion of the center electrode.

According to the first aspect, the ground electrode is disposed by bending at its distal end toward the axis line. Therefore, at the distal end portion of the ground electrode, in particular, at a position apart from the center (line) of the ground electrode in the thickness direction, residual stress (for example, compressive stresses) caused by bending may remain.

In this regard, in the first aspect, the ground electrode includes the thick portion provided on the base end side, the thin portion provided on the distal end side, and the stepped portion provided on the inner peripheral surface side between the thick portion and the thin portion. Then, the first noble metal tip is joined to and partially embedded in the inner peripheral surface of the thin portion. Therefore, in comparison with the case where the stepped portion and the thin portion are not provided, the joined surface of the first noble metal tip can be made closer to the center of the ground electrode in the thickness direction. In other words, the joined portion of the first noble metal tip can be positioned at a portion where the residual stress caused by bending is comparatively small. Therefore, even when the spark plug is used for a long period of time, deterioration in the peel resistance due to the residual stresses can be prevented. If the thin portion is excessively long, the advantages obtained by providing the thick portion and the thin portion may be reduced. In such a perspective, the length from the ground electrode distal end to the stepped portion (length of the thin portion) is preferably 1.2 (mm) or less.

In addition, a smaller diameter of spark plugs has been demanded in recent years, and the diameter of the metal shell tends to be smaller. In this regard, in a following second aspect, the operation and effect described above are more effectively obtained.

In the second aspect, the present invention provides the spark plug according to the first aspect, wherein a relationship $B/A \leqq 2.5$ is satisfied where, when viewed from a side surface of the ground electrode, A (mm) is a thickness of the thick portion of the ground electrode, and B (mm) is a distance between the base end of the inner peripheral surface of the ground electrode and a distal end surface of the ground electrode in the horizontal direction.

Thus, in the second aspect, $B/A \leqq 2.5$ is satisfied where A (mm) is the thickness of the thick portion of the ground electrode, and B (mm) is the distance between the base end of the inner peripheral surface of the ground electrode and the distal end surface of the ground electrode in the horizontal direction (direction perpendicular to the direction of the axis line), so that the ground electrode is tightly bent. In this case, at a position apart from the center (line) in the thickness direction of the ground electrode, larger residual stress caused by bending may remain.

In this regard, as described above, the first noble metal tip is joined to and partially embedded in the inner peripheral surface of the thin portion, so that the joined surface of the noble metal tip can be made closer to the center in the thickness direction of the ground electrode. As a result, even when the spark plug is used for a long period of time, deterioration in peel resistance due to the residual stress can be prevented.

From the perspective of positioning the joined portion of a first noble metal tip for the ground electrode at a portion where the residual stresses caused by bending are smaller, a following third aspect is preferable.

In the third aspect, the present invention provides the spark plug according to the first or second aspect, wherein a relationship $-0.750 \leqq$ "length L2"−"length L1" $\leqq 0.250$ is satisfied where, when viewed from a side surface of the ground electrode, A (mm) is a thickness of the thick portion of the ground electrode; L1 is a center line which is a curve shifted by [A/2] to the inner peripheral side from an outer peripheral line of the ground electrode; a first point "a" is an intersection of the center line L1 and distal end surface of the ground electrode; a second point "b" is an intersection of the center line L1 and a plane including the distal end surface of the metal shell; "length L1" (mm) is a length between the first point "a" and the second point "b" of the center line L1; C (mm) is a thickness of the distal end surface; a first curve L2 is a curve shifted by [C−A/2] to the inner peripheral side from the center line L1; a third point "c" is an intersection of the first curve L2 and the distal end surface; a fourth point "d" is an intersection between the first curve L2 and a plane including a leading end surface of the metal shell; and "length L2" (mm) is a length between the third point "c" and the fourth point "d" of the first curve L2.

Incidentally, "curve shifted by [C−A/2] to the inner peripheral side from the center line L1" is described in the third aspect. When [C−A/2] is a negative value, that is, when $C<A/2$, the first curve L2 is positioned closer to the outer peripheral side than the center line L1. In this case, "length L2"−"length L1" is a positive value.

According to the third aspect, the center line L1 and the first curve L2 may become comparatively proximal to each other (may overlap with each other, of course). In other words, a flat surface to which the first noble metal tip is joined is positioned at a portion where the residual stresses caused by bending are smaller, so that the operation and effect of the first aspect can be more reliably obtained.

In the fourth aspect, the present invention provides the spark plug according to the third aspect, wherein the first noble metal tip protrudes from the distal end surface of the ground electrode, and wherein following relationships are satisfied: $0.5 \leqq D \leqq 1.5$; $0.1 \leqq E \leqq 0.5$; and ("length L3"−"length L2")/$D \leqq 0.30$, where, when viewed from a side surface of the ground electrode, a fifth point "e" is an intersection of the base end surface of the first noble metal tip located on an opposite side of a protruding end surface of the first noble metal tip and the inner peripheral surface of the thin portion; a second curve L3 is a curve shifted from the center line L1 and passing through the fifth point "e"; a sixth point "f" is an intersection of the second curve L3 and the distal end surface of the ground electrode; a seventh point "g" is an intersection of the second curve L3 and the plane including the leading end surface of the metal shell; "length L3" (mm) is a length between the sixth point "f" and the seventh point "g" of the second curve L3; D (mm) is a distance between the distal end surface and the fifth point "e"; and E (mm) is an amount of an embedded portion of the first noble metal tip from the inner peripheral surface of the thin portion.

According to the fourth aspect, the noble metal tip protrudes from the distal end surface (on the axis line side) of the ground electrode. In this case, when a spark discharge is performed between the center electrode and the protruding end portion of the noble metal tip in the protruding direction, ignitability or spark propagation capability can be improved as well as spark consumption resistance.

According to the fourth aspect, on the thin portion inner peripheral surface, D corresponding to a radial distance of a portion to which the first noble metal tip is joined satisfies $0.5 \leqq D \leqq 1.5$, and the embedded amount E of the first noble metal tip from the thin portion inner peripheral surface satisfies $0.1 \leqq E \leqq 0.5$. Therefore, an oxide scale is hardly formed, and as a result, the peel resistance can be further improved. Here, if D is smaller than 0.5 mm, a sufficient joint area may not be secured. On the other hand, if D is more than 1.5 mm, melting of the first noble metal tip into the ground electrode hardly becomes uniform, and as a result, the joint strength (welding strength) becomes uneven, and the peel resistance may deteriorate.

If the embedded amount E of the noble metal tip is smaller than 0.1 mm, the welding is not sufficient, but a joint strength may not be sufficiently secured. On the other hand, if E is more than 0.5 mm, the joint strength is improved, but welding becomes difficult. Particularly, when joining is performed by resistance welding, embedding the first noble metal tip in the ground electrode at more than 0.5 mm requires an excessive current flow, and in the base metal of the ground electrode, a melt solidification called dendrite is formed, and this may deteriorate the oxidation resistance.

Further, in the fourth aspect, ("length L3"−"length L2")/$D \leqq 0.30$ is satisfied where a second curve L3 is a curve shifted from the center line L1 so as to pass through the fifth point "e," and "length L3" (mm) is the length between the sixth point "f" and the seventh point "g" of the second curve L3. Here, ("length L3"−"length L2")/D indicates an inclination of the joined surface of the first noble metal tip on the ground electrode distal end portion with respect to the horizontal plane, and when this exceeds 0.3, it may deteriorate the peel resistance.

From the relationship between the thickness A of the thick portion of the ground electrode and the thickness C of the distal end surface of the ground electrode, following fifth aspect or sixth aspect may be adopted.

In the fifth aspect, the invention provides the spark plug according to the third or fourth aspect, wherein a relationship $0.30 \times A \leqq C \leqq 0.95 \times A$ is satisfied.

The sixth aspect may be adopted instead of the fifth aspect.

In a sixth aspect, the present invention provides the spark plug according to the third or fourth aspect, wherein $0.40 \times A \leqq C \leqq 0.80 \times A$ is satisfied.

According to the fifth or sixth aspect, the joined portion of the noble metal tip can be positioned at a portion where the residual stress caused by bending is smaller. Particularly, by adopting the sixth aspect, the operation and effect of improving peel resistance can be more reliably obtained.

In a seventh aspect, the present invention provides the spark plug according to any of the first to sixth aspects, wherein the center electrode includes a second noble metal tip welded to a leading end of a main body of the center electrode, wherein the main body of the center electrode and the second noble metal tip are joined to each other via a molten bond in which metal components contained in the main body of the center electrode and the second noble metal tip are melted together, wherein the gap is provided between an outer peripheral surface of the second noble metal tip and the first noble metal tip, and wherein a relationship $F \geqq 1.05 \times G$ is satisfied, where: F (mm) is a shortest distance between the first noble metal tip and the molten bond, and G (mm) is a shortest distance of the gap.

As in the seventh aspect, when the center electrode includes a molten bond and the second noble metal tip for the center electrode, if a spark discharge is performed in a direction crossing the axis line, for example, in the lateral direction or a diagonal direction, spark discharge may occur between the molten bond and the second noble metal tip. In this regard, in the seventh aspect, $F \geqq 1.05 \times G$ is satisfied where F (mm) is the shortest distance between the first noble metal tip and the molten bond, and G (mm) is the shortest distance of the gap. Therefore, a flying sparks ratio between the molten bond and the first noble metal tip can be made extremely low, and failures caused by the spark discharge between the molten bond and the first noble metal tip, for example, dropping-off of the second noble metal tip can be reliably prevented.

In a eighth aspect, the present invention provides the spark plug according to any of the first to seventh aspects, wherein the stepped portion and the thin portion are formed by cutting or pressing the distal end portion of the straight rod-shaped ground electrode, thereafter welding the first noble metal tip to the ground electrode, and thereafter bending the ground electrode.

When machining the ground electrode, for example, as in the eighth aspect, by cutting a part of the distal end portion of the straight rod-shaped ground electrode formed of a thick portion having a uniform thickness, or pressing the distal end portion of the ground electrode, the stepped portion and the thin portion are formed. In addition, the first noble metal tip is welded, and thereafter, the ground electrode is bent, and accordingly the gap can be easily finely adjusted. On the other hand, the residual stress is more easily transmitted to the joined surface of the first noble metal tip than in the case where the first noble metal tip is welded after bending. However, as described above, the first noble metal tip is welded to the inner peripheral surface of the thin portion formed by cutting or pressing. Therefore, the joined portion of the first noble metal tip can be positioned at a portion where the residual stresses caused by bending are comparatively small, so that deterioration in the peel resistance can be prevented.

In a ninth, the present invention provides the spark plug according to any of the first to eighth aspects, wherein the first noble metal tip has a prism shape.

As in the ninth aspect, the first noble metal tip having a prism shape can suppress an increase in discharge voltage. Particularly, when a discharge is performed between the first noble metal tip and the outer periphery of the leading end portion of the center electrode, a stable spark discharge is easily realized.

In a tenth aspect, the present invention provides the spark plug according to any of the first to ninth aspects, wherein a depth of the stepped portion is larger than a thickness of the first noble metal tip.

According to the tenth aspect, the depth of the stepped portion is larger than the thickness of the first noble metal tip, and correspondingly, the thin portion is thinned. Therefore, the residual stresses caused by bending of the thin portion can be made smaller, and as a result, the above-described operation and effect can be reliably obtained.

The discharge directions in the spark plugs of the above-described aspects are not especially limited, but may be as shown in the following an eleventh aspect, a twelfth aspect, or a thirteenth aspect.

In the eleventh aspect, the present invention provides the spark plug according to any of the first to tenth aspects, wherein the first noble metal tip protrudes from the distal end surface of the ground electrode, and wherein a protruding end surface in the protruding direction of the first noble metal tip is disposed to face the leading end portion of the center electrode, to perform a spark discharge substantially along a direction perpendicular to the direction of the axis line.

As in the eleventh aspect, it is considered that the technical idea of each aspect described above is embodied in the spark plug in which a spark discharge is performed in a lateral (horizontal) direction. Accordingly, the spark propagation capability can be further improved.

Particularly, the distal end surface of the ground electrode should not reach the axis line in the spark plug of the eleventh aspect, the stress caused by bending may remain at the distal end portion of the ground electrode. However, as described above, the joined portion of the first noble metal tip can be positioned at a portion where the residual stresses caused by bending are comparatively small. Therefore, even if the spark plug is used for a long period of time, deterioration in the peel resistance due to the residual stresses can be prevented.

In the twelfth aspect, the present invention provides the spark plug according to any of the first to tenth aspects, wherein the first noble metal tip protrudes from the distal end surface of the ground electrode, and wherein an end surface of the first noble metal tip located at an end in the direction of the axis line is disposed to face the leading end portion of the center electrode to perform a spark discharge in a direction substantially along the direction of the axis line.

As in the twelfth aspect, the technical ideas of the above-described aspects may be embodied in the spark plug which performs the spark discharge in the longitudinal direction in a manner.

In the thirteenth aspect, the present invention provides the spark plug according to any of first to tenth aspects, wherein the first noble metal tip protrudes from the distal end surface of the ground electrode, and protruding end surface in the protruding direction of the first noble metal tip is disposed to face a part of the axis line which is positioned in a leading end side farther than the center electrode to perform a spark discharge diagonally with respect to the direction of the axis line.

As in the thirteenth aspect, the technical ideas of the above-described aspects may be embodied in a spark plug which performs the spark discharge in a diagonal direction.

In a fourteenth aspect, the present invention provides the spark plug according to any of the first to thirteenth aspect, wherein the inner peripheral surface of the thin portion of the ground electrode has a flat surface perpendicular to the direction of the axis line.

According to the fourteenth aspect, the surface to which the noble metal tip is joined is a flat surface, so that the joining state can be stabilized in comparison with the case where it is joined to a curved surface or slope.

In a fifteenth aspect, the present invention provides a method for producing a spark plug, said spark plug comprising: a rod-shaped center electrode extending in the direction of an axis line; a substantially cylindrical insulator provided on an outer periphery of the center electrode; a cylindrical metal shell provided on an outer periphery of the insulator; a ground electrode having a base end joined to a leading end portion of the metal shell and a distal end bent toward the axis line, the ground electrode comprising: a thick portion provided on a base end side, a thin portion provided on a distal end side, and a stepped portion provided on an inner peripheral surface between the thick portion and the thin portion; a noble metal tip joined to and partially embedded in the inner peripheral surface of a distal end portion of the ground electrode, the noble metal tip being disposed to form a gap between the noble metal tip and the leading end portion of the center electrode, said method comprising: bending the ground electrode toward the axis line; and joining the noble metal tip to the inner peripheral surface of the distal end portion of the ground electrode, wherein after bending the ground electrode toward the axis line, the noble metal tip is joined to the inner peripheral surface of the distal end portion of the ground electrode.

According to the fifteenth aspect, after the ground electrode is bent toward the axis line, the noble metal tip is joined to the distal end portion (thin portion) of the ground electrode. Accordingly, application of the bending stress of the ground electrode caused by bending to the noble metal tip can be suppressed, and the peel resistance of the noble metal tip can be further improved.

In the sixteenth aspect, the present invention provides the method according to the fifteenth aspect, comprising: flattening the inner peripheral surface of the distal end portion of the ground electrode, wherein after bending the ground electrode toward the axis line but before joining the noble metal tip to the inner peripheral surface of the distal end portion of the ground electrode, the inner peripheral surface of the distal end portion of the ground electrode is flattened.

When the fifteenth aspect is adopted, due to bending of the ground electrode, the portion of the ground electrode to which the noble metal tip is joined is bent, and eventually, the joining of the noble metal tip to the ground electrode may become comparatively difficult. In addition, joining of the noble metal tip to the ground electrode is comparatively difficult, so that the joint strength between these may become insufficient. Particularly, when the noble metal tip is joined by resistance welding, due to the bend of the ground electrode, the contact portion between the noble metal tip and the ground electrode becomes comparatively small, so that joining of the noble metal tip to the ground electrode becomes more difficult, and eventually, the joint strength may deteriorate.

In this regard, according to the sixth aspect, after the ground electrode is bent, before the noble metal tip is joined, the inner peripheral surface of the distal end portion (thin portion) of the ground electrode is flattened. Therefore, the noble metal tip can be comparatively easily stably joined to the ground electrode, and therefore, the joint strength of these can be further improved. As a result, the peel resistance of the noble metal tip can be further improved.

In a seventeenth aspect, the present invention provides the method according to the fifteenth or sixteenth aspect, comprising: fitting the metal shell having the ground electrode joined to the distal end portion thereof to the insulator having the center electrode attached thereto, wherein after joining the noble metal tip to the inner peripheral surface of the leading end portion of the ground electrode, the metal shell and the insulator are fitted to each other.

In the method of producing the spark plug, generally, after the metal shell having a ground electrode which has not been bent (has a straight rod shape) and an insulator having a center electrode are fitted to each other, a noble metal tip is joined to the ground electrode, and then the ground electrode is bent. However, as in the fifteenth aspect, in the case where the ground electrode is bent before the noble metal tip is joined, if the above-described method in which the metal shell and the insulator are fitted to each other before the noble metal tip is joined is used, the distal end portion of the ground electrode and the leading end portion of the center electrode are comparatively close in position to each other, so that a sufficient space for joining the noble metal tip may not be secured.

In this regard, according to the seventeenth aspect, the metal shell and the insulator are fitted to each other after the noble metal tip is joined, so that a sufficient space for joining the noble metal tip to the ground electrode can be secured. As a result, operability can be greatly improved. In addition, the noble metal tip can be more reliably and accurately joined to the ground electrode, and therefore, the joint strength can be further improved.

BRIEF DESCRIPTION OF THE DRAWINGS

FIG. 6A is a side view schematically showing the distal end portion of the ground electrode, and FIG. 6B is a side view schematically showing the base end portion of the ground electrode;

DESCRIPTION OF THE EMBODIMENTS

An embodiment of the present invention is described with reference to the drawings. However, the present invention should not be construed as being limited thereto.

First Embodiment

Figure 1:
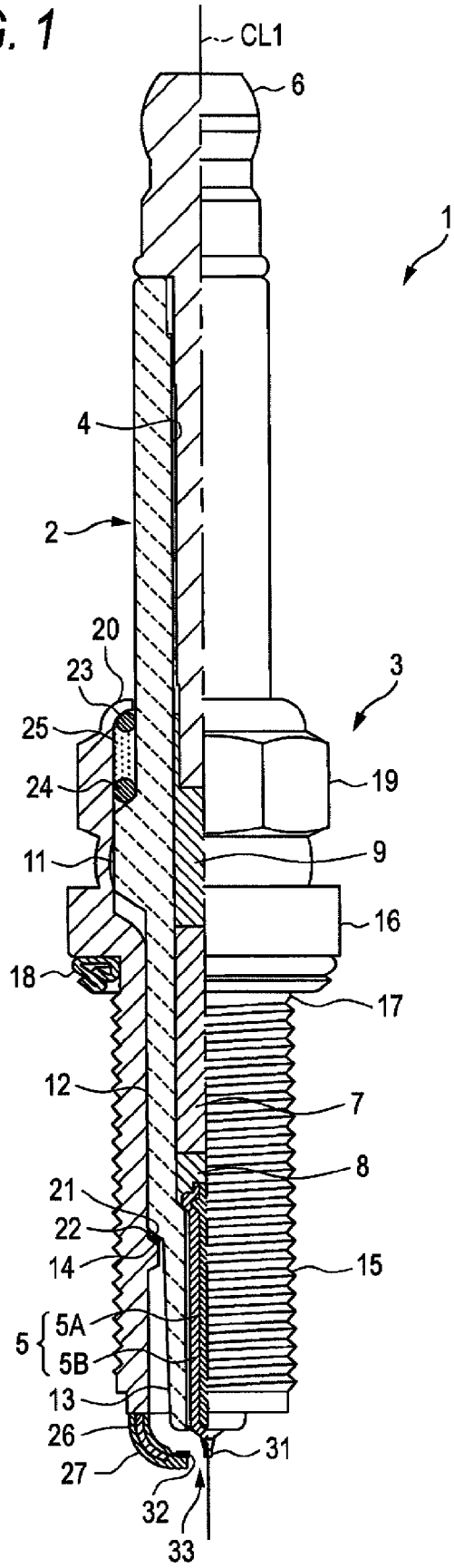
FIG. 1 is a partially sectional side view showing a configuration of a spark plug of the present embodiment.

FIG. 1 is a partial sectional view of a spark plug 1. In the description, a direction of an axis line CL1 of the spark plug 1 (also referred to as an axial direction) corresponds to a vertical direction in FIG. 1. In addition a lower side in FIG. 1 corresponds to a leading end side of the spark plug 1, and an upper side in FIG. 1 corresponds to a base end side of the spark plug 1.

The spark plug 1 includes an insulator 2 serving as an insulating material and a cylindrical metal shell 3 holding the insulator 2.

The insulator 2 has an axial hole 4 penetrating therethrough along the axis line CL1. A center electrode 5 is inserted and fixed to the leading end portion of the axial hole 4, whereas a terminal electrode 6 is inserted and fixed to the base end portion thereof. A resistor 7 is disposed between the center electrode 5 and the terminal electrode 6 in the axial hole 4. Both ends of the resistor 7 are electrically connected to the center electrode 5 and the terminal electrode 6 via electrically-conductive glass seal layers 8 and 9, respectively.

The center electrode 5 is fixed to protrude from the leading end of the insulator 2, and the terminal electrode 6 is fixed in the state of protruding from the base end of the insulator 2. A noble metal tip (noble metal tip for a center electrode) 31 containing iridium as a main component is joined to the leading end of the center electrode 5 by welding.

On the other hand, the insulator 2 is formed by sintering alumina or the like, and has an outer shape including a flange-shaped large diameter portion 11 that protrudes radially-outwardly at a substantially center portion in the direction of the axis line CL1, an intermediate barrel portion 12 disposed on the leading end side and is smaller in diameter than the large diameter portion 11, and a leg portion 13 disposed on the leading end side and is smaller in diameter than the intermediate barrel portion 12 and that is exposed to a combustion chamber of the internal combustion engine. A leading end portion of the insulator 2, which includes the large diameter portion 11, the intermediate barrel portion 12 and the leg portion 13, is housed in the cylindrical metal shell 3. A step portion 14 is formed at the connection part between the leg portion 13 and the intermediate barrel portion 12, and firmly engages the insulator 2 with the metal shell 3.

The metal shell 3 contains metal, such as low-carbon steel, and is formed in a cylindrical shape. The metal shell 3 has an outer circumferential surface provided with a threaded portion 15 (male screw portion) used to attach the spark plug 1 to a cylinder head of the engine. A seat portion 16 is formed on the outer circumferential surface on the base end side of the threaded portion 15. A ring-shaped gasket 18 is fitted to a screw neck 17 formed at the base end of the threaded portion 15. A tool-engaging portion 19 of hexagon in cross section used to engage a tool, such as a wrench, when the metal shell 3 is attached to the cylinder head is disposed on the base end side of the metal shell 3. Additionally, a crimping portion 20 used to hold the insulator 2 at its base end portion is disposed on the base end side of the metal shell 3.

The metal shell 3 has an inner circumferential surface provided with a step portion 21 used to engage the insulator 2. The insulator 2 is inserted from the base end side toward the leading end side of the metal shell 3, and the step portion 14 thereof is firmly engaged with the step portion 21 of the metal shell 3. In this state, an opening on the base end side of the metal shell 3 is tightened radially inwardly, i.e., the crimping portion 20 is formed, and, as a result, the insulator 2 is firmly fixed. An annular plate packing 22 is interposed between the step portion 14 of the insulator 2 and the step portion 21 of the metal shell 3. Accordingly, the airtightness of the combustion chamber is maintained, so that fuel air that enters a gap between the leg portion 13 of the insulator 2 exposed to the combustion chamber and the inner circumferential surface of the metal shell 3 cannot leak outwardly.

Additionally, to be more completely sealed up by crimping, annular ring members 23 and 24 are interposed between the metal shell 3 and the insulator 2 on the base end side of the metal shell 3, and the gap between the ring members 23 and 24 is filled with talc powder 25. In other words, the metal shell 3 holds the insulator 2 by means of the plate packing 22, the ring members 23 and 24, and the talc powder 25.

A ground electrode 27 is joined to the leading end surface 26 of the metal shell 3. More specifically, the ground electrode 27 includes a base end portion welded to the leading end surface 26 of the metal shell 3, and a distal end portion bent toward the side of the axis line CL1 so that a distal end surface of the distal end portion can almost exactly face the outer circumferential surface of the noble metal tip 31. In the present embodiment, the ground electrode 27 is provided with a noble metal tip (a noble metal tip for ground electrode) 32 disposed so as to face the noble metal tip 31. In more detail, the noble metal tip 32 is welded to the ground electrode 27 such that a part of the noble metal tip 32 is embedded therein, and another part of the noble metal tip 32 protrudes from the distal end surface 27*s* on the side of the axis line CL1 of the ground electrode 27 toward the axis line CL1 (see FIG. 2). The gap between these noble metal tips 31 and 32 serves as a spark discharge gap 33. Therefore, in the present embodiment, a spark discharge is to be performed in the direction substantially perpendicular to the direction of the axis line CL1.

Figure 2:
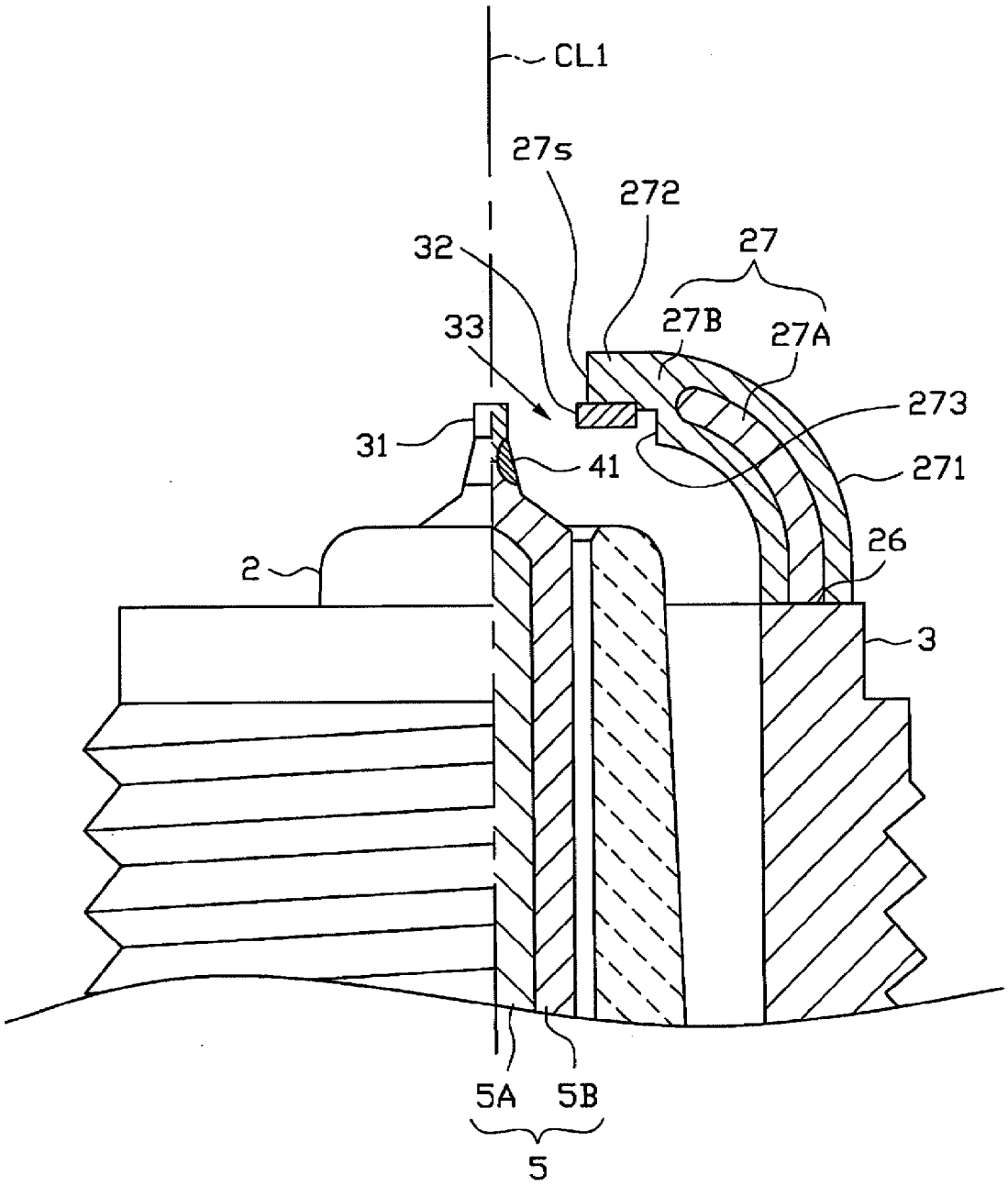
FIG. 2 is a partially enlarged sectional view of the spark plug.

As shown in FIG. 2, a main body of the center electrode 5 includes an inner layer 5A containing copper or a copper alloy and an outer layer 5B containing a nickel (Ni) alloy. The main body of the center electrode 5 includes a leading end portion reduced in diameter, has a rod-shaped (cylindrical) shape as a whole, and has a leading end surface formed flat. The cylindrical noble metal tip 31 is laid on this, and the outer edge of the resulting joint area is subjected to laser beam welding or electron beam welding etc. As a result, the noble metal tip 31 and the main body of the center electrode 5 are melted together, and a molten bond 41 is formed. In other words, the noble metal tip 31 is joined to the leading end of the main body of the center electrode 5 by being firmly fixed by the molten bond 41.

On the other hand, the ground electrode 27 has a two-layer structure including an inner layer 27A and an outer layer 27B. The outer layer 27B in the present embodiment contains a nickel alloy, such as INCONEL (trade name) 600 or 601, whereas the inner layer 27A contains a nickel alloy or pure copper that is metal superior in thermal conductivity to the above-mentioned nickel alloy. Since the inner layer 27A is provided, heat dissipation property can be improved. In the present embodiment, basically, the ground electrode 27 has a substantially rectangular shape in cross section.

Although the fact that the noble metal tip 31 disposed on the side of the center electrode 5 containing iridium as a main component has been mentioned above, the noble metal tip 32 disposed on the side of the ground electrode 27 contains a noble metal alloy containing rhodium in an amount of 20 mass % and a main component such as platinum. However, these material compositions are mentioned as an example, but not limited thereto. For example, the noble metal tips 31 and 32 are produced as follows. First, an ingot containing iridium or platinum as a main component is prepared, respective alloying elements are then mixed and melted to form the predetermined composition mentioned above, an ingot is then formed for the melted alloy again, and is subjected to hot forging and hot rolling (groove rolling). Thereafter, this is subjected to wire drawing, and, as a result, a rod-shaped material is obtained. Thereafter, this is cut to have a predetermined length, and, as a result, the cylindrical noble metal tip 31 and the prism-shaped noble metal tip 32 can be obtained.

Figure 3:
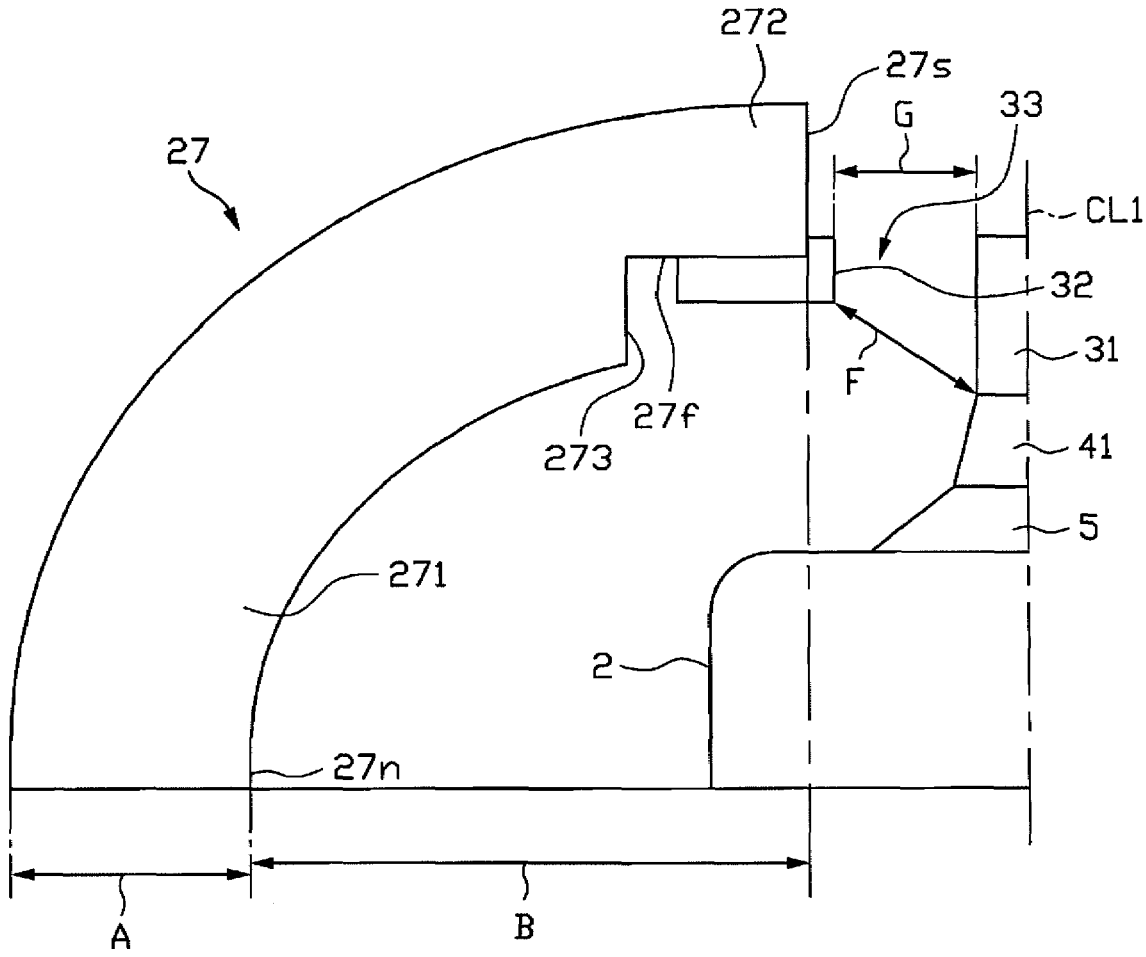
FIG. 3 is a schematic side view showing a major portion in an enlarged manner.

As described above, the noble metal tip 32 joined to the ground electrode 27 protrudes toward the axis line CL1 from the distal end surface 27*s* of the ground electrode 27 on the axis line CL1 side. Particularly, in the present embodiment, as shown in FIG. 2 and FIG. 3, the ground electrode 27 includes a thick portion 271 positioned on a base end side of the ground electrode 27, a thin portion 272 positioned on a distal end side of the ground electrode 27, and a stepped portion 273 provided on an inner peripheral surface side (lower surface side in FIGS. 2 and 3) between the thick portion 271 and the thin portion 272. In the present embodiment, the inner peripheral surface of the thin portion 272 has a flat surface 27*f* extending in a direction perpendicular to the axis line CL1. In other words, the inner peripheral side of the distal end portion of the ground electrode 27 is notched into a hook shape so as to provide the stepped portion 273 and the flat surface 27*f*. The noble metal tip 32 is welded to and partially embedded in the flat surface 27*f*.

As shown in FIG. 3, B/A≦2.5 is satisfied where, when viewed from a side surface of the ground electrode 27, A (mm) is the thickness of the thick portion 271 of the ground electrode 27, and B (mm) is the distance between the base end of the inner peripheral surface of the ground electrode 27 and the distal end surface of the ground electrode 27 in the horizontal direction (referred to as "radial direction" in some cases). Therefore, the ground electrode 27 is bent in a comparatively tight manner.

Figure 4:
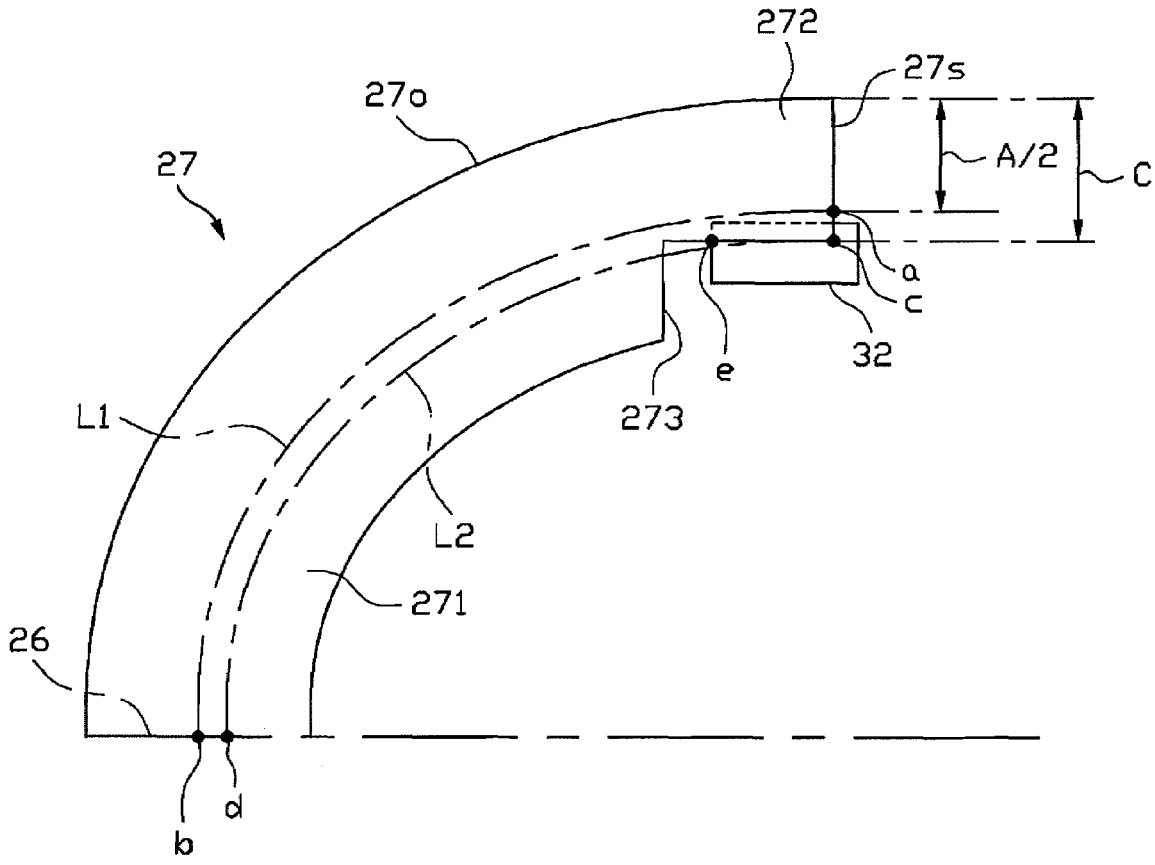
FIG. 4 is a side view schematically showing a major portion of the ground electrode to describe the concept of the center line, etc.

Further, in the present embodiment, as shown in FIG. 4, when viewed from a side surface of the ground electrode 27, L1 is the center line which is a curve shifted (offset) by [A/2] to the inner peripheral side from an outer peripheral line 27*o* of the ground electrode 27, a first point "a" is an intersection of the center line L1 and an distal end surface 27*s* of the ground electrode 27, a second point "b" is an intersection of the center line L1 and the base end portion of the ground electrode 27 joined to the leading end surface 26 of the metal shell 3 (intersection of the center line L1 and a plane including the leading end surface 26 of the metal shell 3), and "length L1" (mm) is the length between the first point "a" and the second point "b" of the center line L1.

Further, C (mm) is the thickness of the distal end surface of the ground electrode 27 (also see FIG. 5A and FIG. 5B, etc.), a first curve L2 is a curve shifted by [C−A/2] to the inner peripheral side from the center line L1, a third point "c" is an intersection of the first curve L2 and the distal end surface 27*s*, a fourth point "d" is an intersection between the first curve L2 and the base end portion of the ground electrode 27 joined to the leading end surface 26 of the metal shell 3 (intersection of the first curve L2 and the plane including the leading end surface 26 of the metal shell 3), and "length L2" (mm) is the length between the third point "c" and the fourth point "d" of the first curve L2. In this case, in the present embodiment, −0.750≦"length L2"−"length L1"≦0.250 is satisfied.

Incidentally the "curve shifted by [C−A/2] to the inner peripheral side from the center line L1" is described. When [C−A/2] is a negative value, that is, when C<A/2, the first curve L2 is positioned closer to the outer peripheral side than the center line L1. In the figures, the case where [C−A/2] is a positive value is illustrated.

Figure 6A:
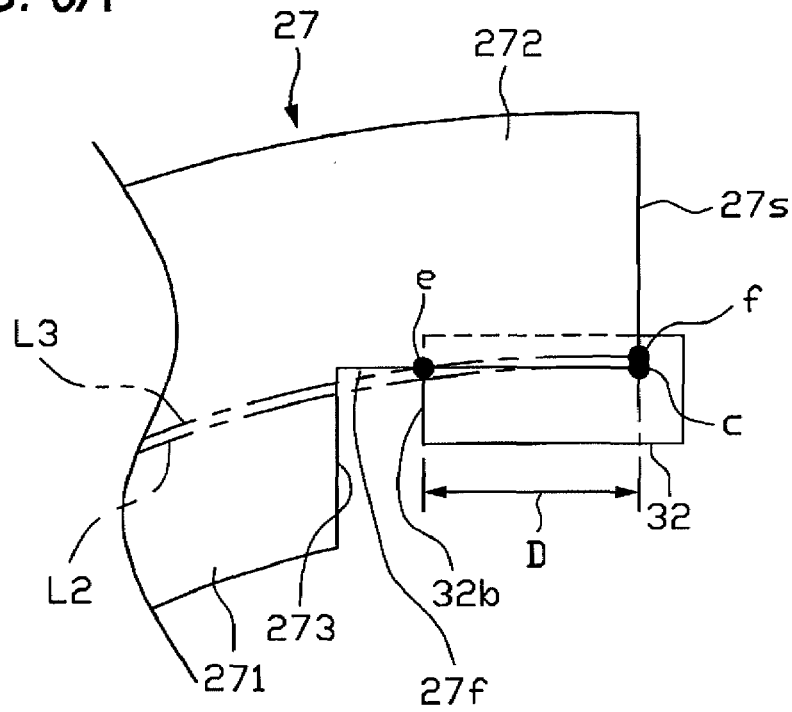
FIG. 6A and FIG. 6B are views describing the concept of the first curve and the second curve, etc., where
Figure 6B:
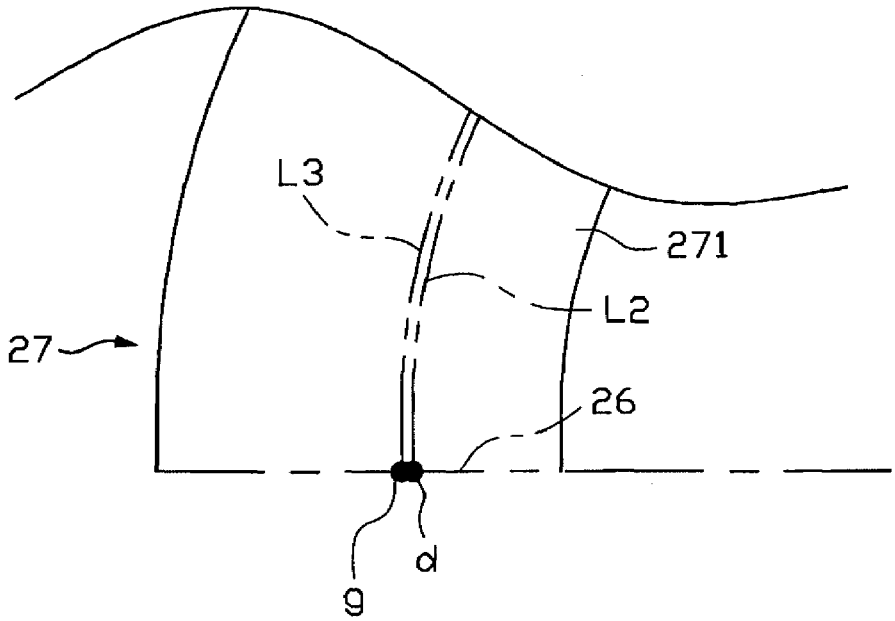

In addition, in the present embodiment, when viewed from a side surface of the ground electrode 27, a fifth point "e" is an intersection of the base end face 32*b* on the opposite side (left side of FIG. 6A) of the protruding end surface of the noble metal tip 32 on the protruding side and the flat surface 27*f*, and a second curve L3 is a curve shifted from the center line L1 so as to pass through the fifth point "e." A sixth point "f" is an intersection of the second curve L3 and the distal end surface 27*s* of the ground electrode 27, a seventh point "g" is an intersection of the second curve L3 and the base end portion of the ground electrode 27 joined to the leading end surface 26 of the metal shell 3 (intersection of the second curve L3 and the plane including the leading end surface 26 of the metal shell 3), and "length L3" (mm) is the length between the sixth point "f" and the seventh point "g" of the second curve L3.

In the present embodiment, 0.5≦D≦1.5 is satisfied where D (mm) is the distance between the distal end surface 27*s* and the fifth point "e." Further, 0.1≦E≦0.5 is satisfied where E (mm) is a embedded amount of the noble metal tip 32 from the flat surface 27*f*. Further, ("length L3"−"length L2")/D≦0.30 is also satisfied.

Figure 5A:
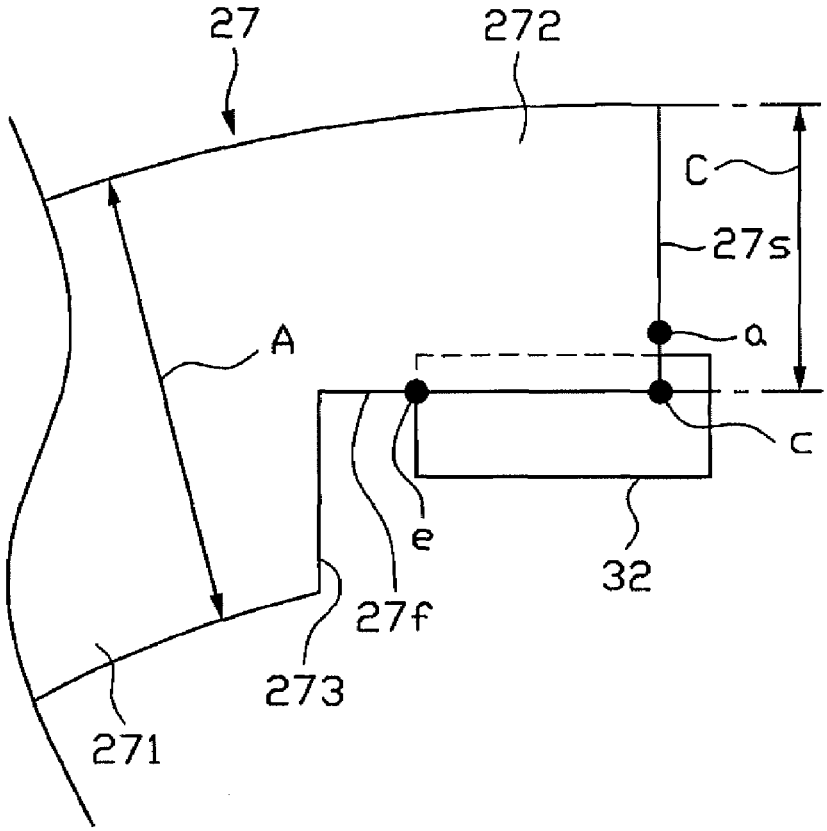
FIG. 5A is a side view schematically showing a major portion of the ground electrode.
Figure 5B:
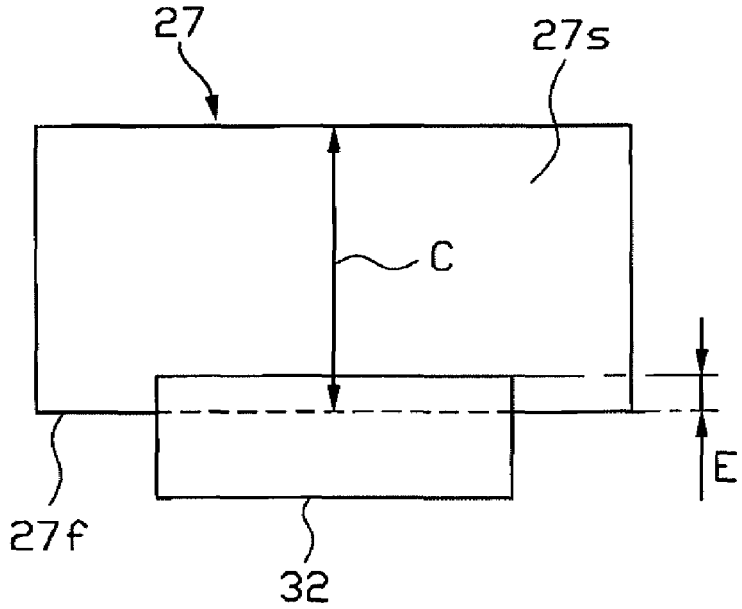
FIG. 5B is a front view (back side is not shown) showing the ground electrode viewed from the protruding end surface side on the projection side.

Additionally, in the present embodiment, as shown in FIG. 5A and FIG. 5B, 0.30×A≦C≦0.95×A is satisfied, and particularly, 0.40×A≦C≦0.80×A is satisfied.

Further, it is described above that the main body of the center electrode 5 and the noble metal tip 31 for the center electrode are joined via the molten bond 41, and in the present embodiment, as shown in FIG. 3, $F \geqq 1.05 \times G$ is satisfied where F (mm) is the shortest distance between the molten bond 41 and the noble metal tip 32, and G (mm) is the shortest distance of the spark discharge gap 33. Accordingly, a spark discharge between the molten bond 41 and the noble metal tip 32 is suppressed.

Next, a description will be given of a method of producing the spark plug 1 while centering on a process of producing the ground electrode 27 and the like. First, the metal shell 3 is pre-processed. In more detail, a cylindrical metallic material (for example, a stainless material or an iron-based material such as S15C or S25C) is subjected to cold forging so as to form a through-hole, and forms its outline. Thereafter, the resulting material is subjected to a cutting process so as to adjust the outline, thus obtaining a metal shell intermediate body.

On the other hand, a semi-finished material for the ground electrode 27 having a rectangular shape in cross section is produced. That is, the semi-finished material for the ground electrode 27 is a rod-shaped material that has not yet been bent. For example, the ground electrode 27 that has not yet been bent can be obtained as follows.

In detail, a core containing a metallic material used for the inner layer 27A and a bottomed cylinder containing a metallic material used for the outer layer 27B are prepared (both not shown). Thereafter, a cup material is formed by fitting the core to a concave part of the bottomed cylinder. Thereafter, the cup material having the two-layer structure is subjected to a cold thinning process. For example, a wire drawing process using a die or the like or an extrusion molding process using a female die or the like can be mentioned as the cold thinning process. Thereafter, the resulting material is subjected to, for example, a swaging process, and, as a result, a rod-shaped product reduced in diameter is formed.

Thereafter, the ground electrode 27 (rod-shaped product) that has not yet been bent and has not yet been attached to a tip is joined to the leading end surface of the metal shell intermediate body by resistance-welding. Since a so-called "sag" is generated when the resistance welding is performed, an operation to remove the "sag" is performed. In this example, after performing the swaging process, the cutting process, etc., the ground electrode 27 that has not yet been bent is joined according to resistance-welding. However, after performing the thinning process, the rod-shaped product may be joined to the metal shell intermediate body. Thereafter, the swaging process may be performed, and then the cutting process may be performed. If so, when the swaging process is performed, the rod-shaped product joined to the leading end surface of the metal shell intermediate body can be introduced from the leading end side into a processing part (swaging die) of a swager in the state of holding the metal shell intermediate body. Therefore, it becomes unnecessary to purposely set the rod-shaped product to be long in order to secure a part used to hold it when the swaging process is performed.

Thereafter, the threaded portion 15 is formed at a predetermined portion of the metal shell intermediate body by being screwed. As a result, the metal shell 3 to which the ground electrode 27 before being bent is welded is obtained. The metal shell 3 and the other elements are subjected to galvanizing or nickeling. To improve corrosion resistance, the surface of the metal shell 3 may be further subjected to chromating.

The distal end portion of the ground electrode 27 is notched in a hook shape by cutting or pressing to form a flat surface 27*f* (the thin portion 272 and the stepped portion 273). The notching may be performed after or before roll-threading a threaded portion 15. When the notching is performed before roll-threading the threaded portion 15, it may be before or after welding to a metal shell intermediate body.

On the other hand, as described above, a prism-shaped noble metal tip 32 is prepared, and this noble metal tip 32 is joined by resistance welding to the ground electrode 27. At this time, resistance welding is performed while the noble metal tip 32 is pressed against the flat surface 27*f* of the ground electrode 27 so that the embedded amount E (mm) of the noble metal tip 32 in the flat surface 27*f* satisfies $0.1 \leqq E \leqq 0.5$. To make the welding more reliable, plating removal at the welding portion is performed or masking is applied to the portion to be welded in the plating step before the welding. It is also possible that the noble metal tip 32 is welded after the fitting described later (before bending).

On the other hand, the insulator 2 is molded independently of the metal shell 3. For example, a basis granulation material for molding is prepared by use of raw powder containing alumina as a main component and a binder, and rubber press molding is performed by using this, and, as a result, a cylindrical mold is obtained. The resulting mold is ground and shaped. Thereafter, the shaped mold is put into a baking furnace and is baked, and, as a result, the insulator 2 is obtained.

Additionally, the center electrode 5 is produced independently of the metal shell 3 and the insulator 2. In detail, a Ni-based alloy is forged, and a copper core is disposed at the middle of the Ni-based alloy in order to improve heat radiation, thus obtaining the main body. Thereafter, the noble metal tip 31 as mentioned above is joined to the leading end portion of the center electrode by laser beam welding or the like.

The obtained center electrode 5 to which the noble metal tip 31 is joined and the terminal electrode 6 are airtightly fixed to the axial hole 4 of the insulator 2 by means of a glass seal (not shown). Generally, a seal formed by mixing and preparing borosilicate glass and metal powder together is used as the glass seal. Thereafter, the center electrode 5 is first brought into the state of being inserted in the axial hole 4 of the insulator 2, the prepared sealant is then put into the axial hole 4 of the insulator 2, the terminal electrode 6 is then pressed from the rear, and these are baked in the baking furnace. At this time, a glaze layer may be baked at the same time on the surface of the barrel portion on the base end side of the insulator 2, or a glaze layer may be beforehand formed.

Thereafter, the insulator 2 having the center electrode 5 and the terminal electrode 6 structured as above, respectively, and the metal shell 3 having the straight rod-shaped ground electrode 27 structured as above are assembled together. In more detail, the base end portion of the metal shell 3 formed to be comparatively thin is subjected to cold crimping or hot crimping, and hence is held such that a part of the insulator 2 is surrounded by the metal shell 3 from the circumferential direction.

Finally, the straight rod-shaped ground electrode 27 is bent, and a process to adjust the spark discharge gap 33 between the center electrode 5 (the noble metal tip 31) and the ground electrode 27 (the noble metal tip 32) is performed.

The spark plug 1 structured as above is produced by following these series of steps.

As described in detail above, according to the present embodiment, the prism-shaped noble metal tip 32 is welded so as to protrude toward the axis line CL1 from the distal end surface 27*s* of the ground electrode 27, and a spark discharge is performed laterally. Therefore, ignitability or spark propagation capability can be improved as well as spark wear resistance.

On the other hand, the ground electrode 27 of the present embodiment is comparatively tightly bent, and at the distal end portion of the ground electrode 27, in particular, at a position apart from the center line L1, comparatively large residual stresses (for example, compressive stresses) caused by bending may remain. In this regard, in the present embodiment, the inner side of the distal end portion of the ground electrode 27 is notched so as to include a flat surface 27*f*, and the noble metal tip 32 is welded to and partially embedded in the flat surface 27*f*. The joined surface of the noble metal tip 32 can be made closer to the center of the ground electrode 27 in the thickness direction. In other words, the joined portion of the noble metal tip 32 can be positioned at a portion where the residual stresses caused by bending are comparatively small. Therefore, even when the spark plug is used for a long period of time, deterioration in the peel resistance due to the residual stresses can be prevented.

Here, to confirm the effects mentioned above, various samples were formed, and various valuations were made. The experimental results are explained below.

Figure 7A:
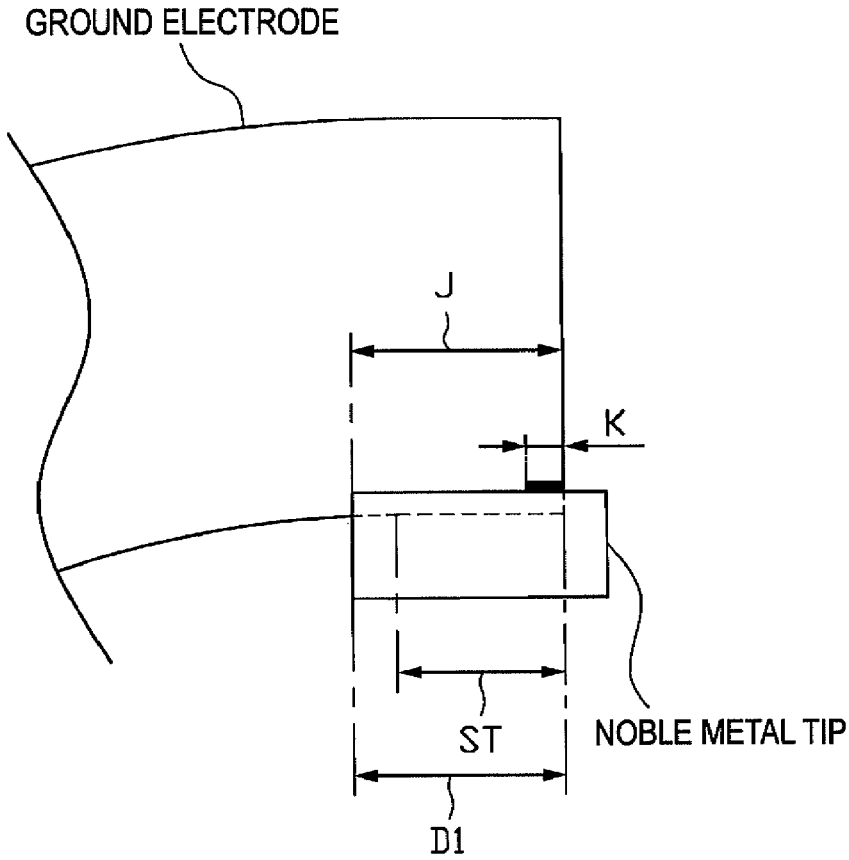
FIG. 7A and FIG. 7B are both sectional end views for describing the concept of samples to be used in the valuation experiment (hatching is not shown for convenience)

Before explaining the evaluation of the effects of the present embodiment, various experiments were performed for the case where a noble metal tip is welded to the inner peripheral surface of the ground electrode so as to protrude in the direction of the axis line, the inner peripheral surface was not notched (that is, the ground electrode were formed only by the thick portion). First, as shown in FIG. 7A, a distance D1 is defined as, when viewed from a side surface of the ground electrode, a distance between ends of a contact surface of the inner peripheral surface which contacts the noble metal tip when the noble metal tip is joined (corresponding to "D" in the above embodiment), and a straight length ST is defined as a length of the distal end portion of the ground electrode at which the surface is flat in cross section [i.e., a length of the portion where the distal end inner side surface is formed into a flat surface (straight in section)]. Samples were prepared in which the distances D1 were set to 0.5 mm, 1.0 mm, and 1.5 mm, and the various straight lengths ST were set for each D1, and then a tendency to develop oxide scale was evaluated for each sample. In detail, ground electrode samples (not notched) in which the distance D1 and the distal end straight length ST were variously changed were manufactured, and a desk burner test was conducted. The desk burner test includes repeated cycles, and each cycle includes: heating the sample for 2 minutes by a burner such that the distal end temperature reaches 1100° C.; and then slowly cooling the supple for 1 minute. Thereafter, by observing a cross section of the sample, the ratio of a length K of a formed oxide scale (see the schematic view of FIG. 7A) to the length J of a boundary surface region between the ground electrode and the noble metal tip (see also FIG. 7A) was measured, and the number of cycles when the oxide scale ratio exceeded 50% was evaluated. Here, a peeling limit is defined as the number of cycles when the oxide scale ratio exceeded 50% is less than 1000. However, when the oxide scale ratio does not exceed 50% even after repeating the cooling and heating cycle 1500 times, the peel resistance was evaluated as sufficient and the test was ended at 1500 cycles. The results of this test are shown in FIG. 8.

Figure 8:
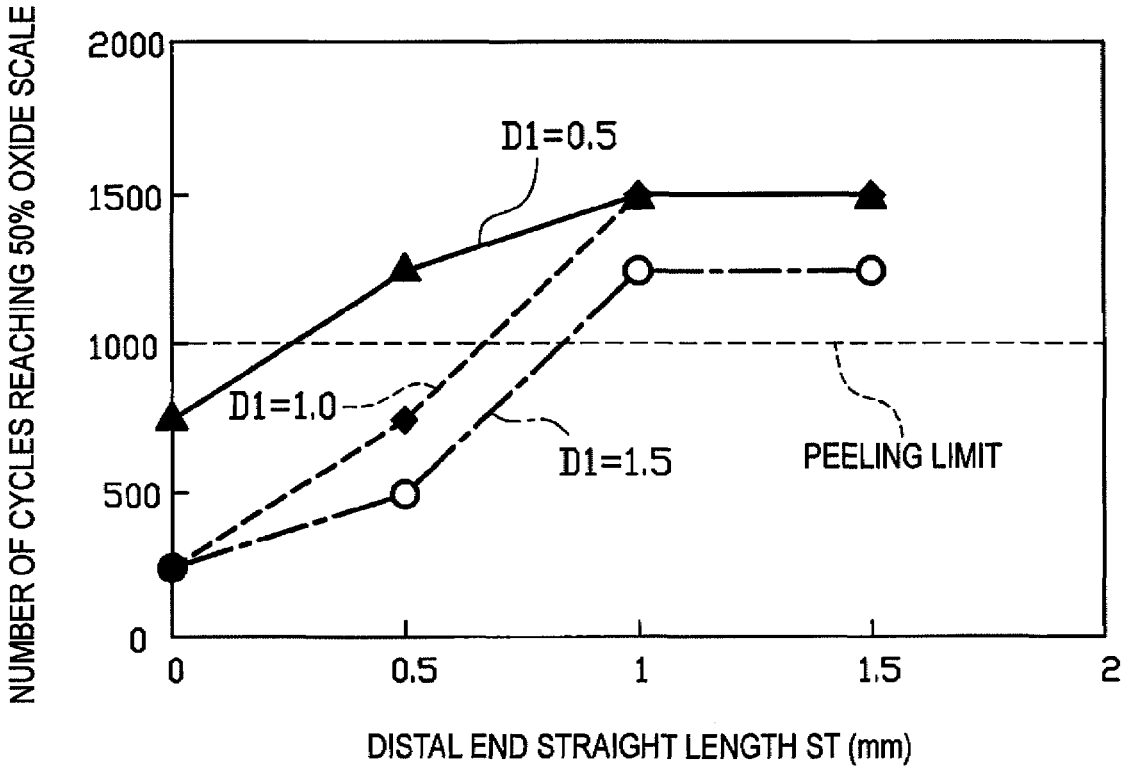
FIG. 8 is a graph showing the relationship of the number of cycles reaching 50% oxide scale to the distal end straight length ST in the ground electrode samples in which the distance D1 to the contact surface and the distal end straight length ST were variously changed.

As seen in FIG. 8, it was found that, in the range of 0.5 to 1.5 mm of the distance D1, when the straight length ST of the distal end portion of the ground electrode was 1.0 mm or more, the number of cycles reaching 50% oxide scale exceeded 1000. In other words, when the straight length ST of the distal end portion of the ground electrode is 1.0 mm or more, there is no need to concern about the peel resistance of the noble metal tip. On the other hand, it was found that when the straight length ST of the distal end portion of the ground electrode was only less than 1.0 mm, it adversely influenced the peel resistance of the noble metal tip. In other words, when bending stresses remain on the ground electrode distal end portion, the peel resistance of the noble metal tip is easily deteriorated.

From the results of the test, when the straight length ST of the distal end portion (inner side) of the ground electrode is 1.0 mm or more, there is no need to concern about the peel resistance of the noble metal tip. Based on this, samples variously changed so that the straight length ST of the distal end portion (inner side) of the ground electrode became 1.0 mm, the thickness A of the thick portion of the ground electrode was changed to 1.0 mm, 1.3 mm, and 1.6 mm, and the value of B/A became "1.5," "2.0," "2.5," and "3.0" were manufactured and subjected to a heating and vibration durability test. In detail, while the bent portion of the ground electrode in each sample was heated to 900° C., vibration of a frequency of 200 Hz was continuously applied thereto, and a time required until the bent portion was broken (endurance time) was measured. When breakage did not occur for 10 hours or more, it was evaluated as having sufficient breaking strength. The results in this case are shown in FIG. 9.

Figure 9:
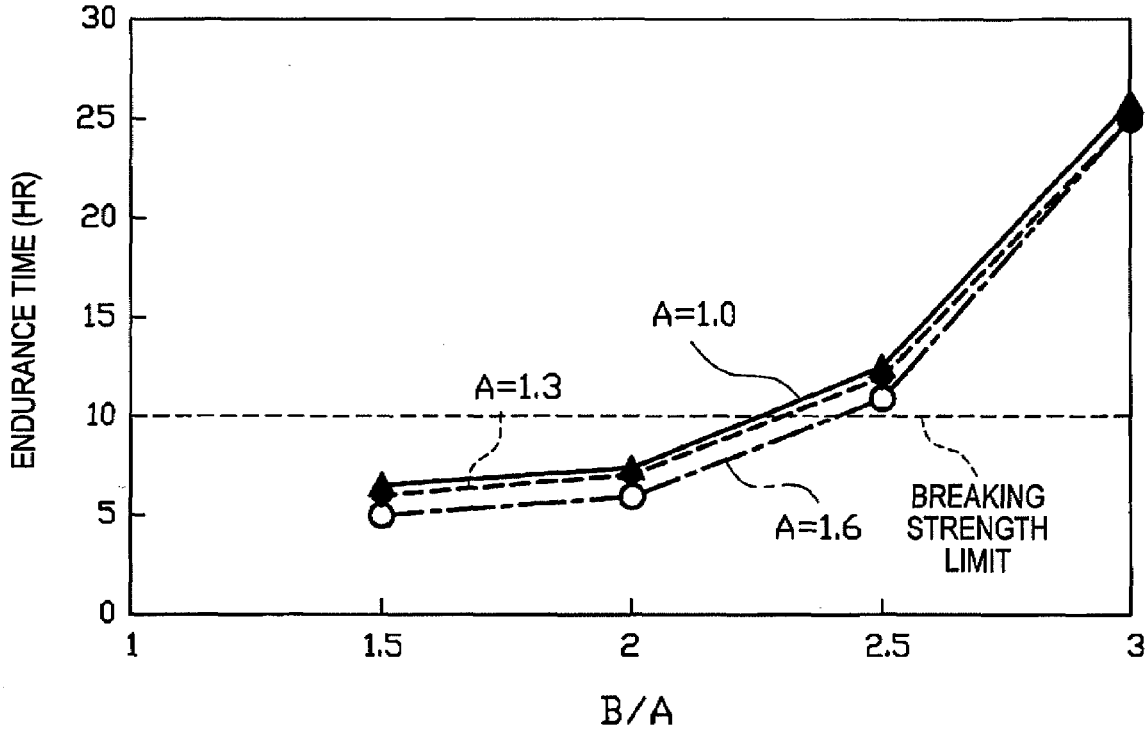
FIG. 9 is a graph showing the relationship of the endurance time to B/A, showing heating and vibration test results.

As shown in FIG. 9, when the value of B/A is 2.5 or more, the breaking strength is sufficient. On the other hand, when the value of B/A is less than 2.5, the bent portion is easily broken, and sufficient breaking strength cannot be obtained. In other words, if the ground electrode is forcibly bent in order to secure a straight length of 1.0 mm or more on the distal end portion (inner side) of the ground electrode, the breaking strength of the bent portion may deteriorate.

On the other hand, in the present embodiment, the notching is applied to the ground electrode required to have the value B/A of 2.5 or less as an essential requirement, to form the thin portion 272 and the stepped portion 273. In other words, when the value of B/A is 2.5 or less, forcible bending with a high curvature is inevitably applied in order to secure the predetermined straight length, which deteriorates the breaking strength. On the other hand, in the present embodiment, by forming the flat surface 27*f* by notching, even when the value of B/A is 2.5 or less, deterioration in the breaking strength due to forcible bending with a high curvature is not caused, and a sufficient straight length is secured and the peel resistance is prevented from being deteriorated.

Figure 10:
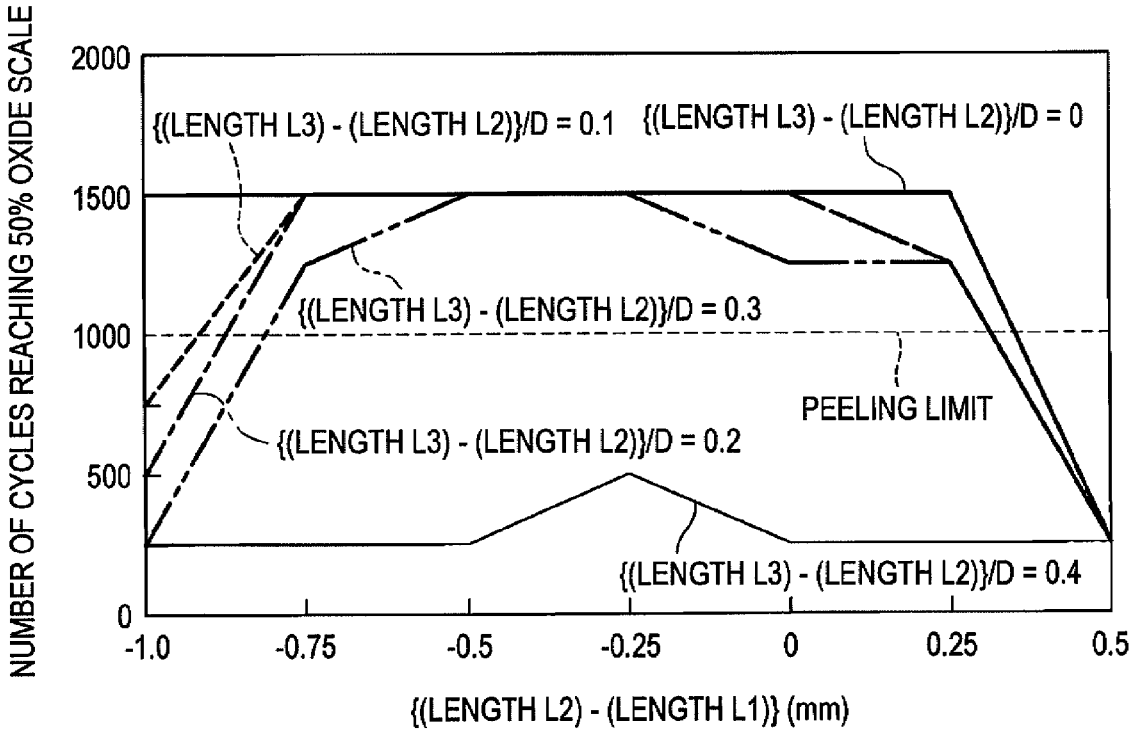
FIG. 10 is a graph showing the relationship of the number of cycles reaching 50% oxide scale to the value of ("length L2"−"length L1") in samples in which the value of ("length L3"−"length L2)/D was variously changed.
Figure 11:
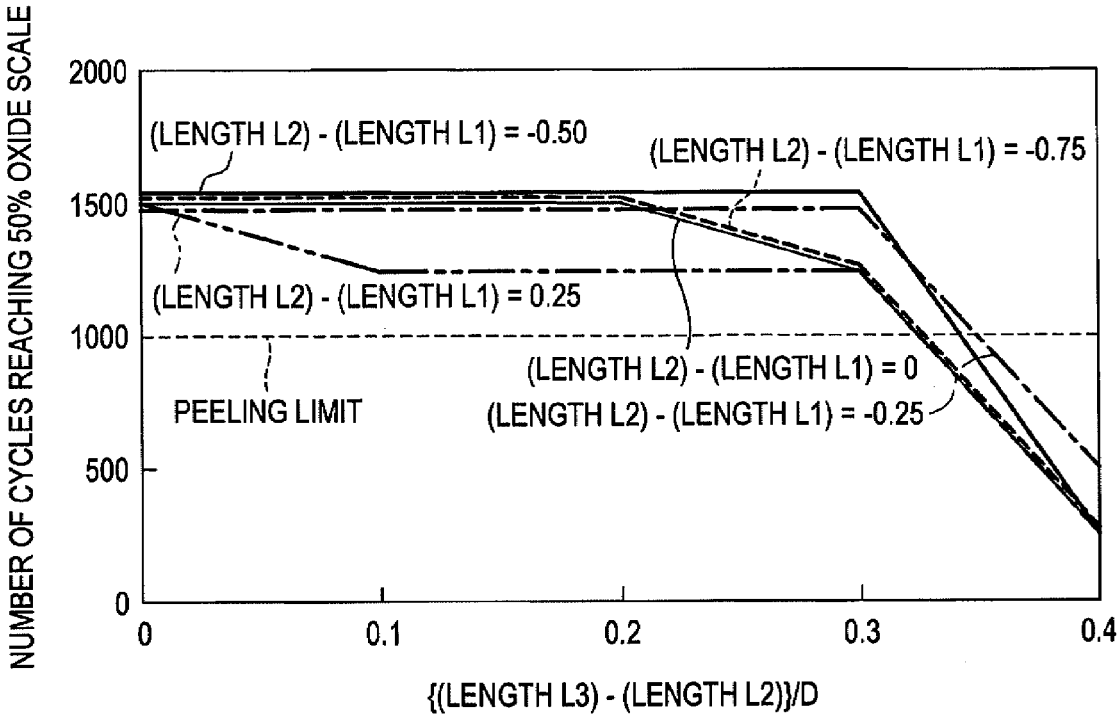
FIG. 11 is a graph showing the relationship of the number of cycles reaching 50% oxide scale to the value of ("length L3"–"length L2")/D in samples in which the value of ("length L2"–"length L1") was variously changed.

Next, samples in which "length L2" (mm) between the third point "c" and the fourth point "d" of the first curve L2 and "length L3" (mm) between the sixth point "f" and the seventh point "g" of the second curve L3 were variously changed with respect to "length L1" (mm) between the first point "a" and the second point "b" of the above-described center line L1, were manufactured, the desk burner valuation test (the same as described above) was carried out, and the number of cycles at which the oxide scale ratio exceeded 50% was evaluated. After this test, various tests are carried out upon providing a flat surface by notching the distal end portion of the ground electrode. In other words, the oxide scale ratio means a ratio of the length K of a formed oxide scale to the length J of a boundary surface region between the ground electrode and the noble metal tip as shown in the schematic view of FIG. 7B in the ground electrode having the flat surface. The results of the test are shown in FIG. 10 and FIG. 11. However, FIG. 10 shows the numbers of cycles reaching 50% oxide scale when the value of ("length L2"−"length L1") was variously changed in the range between −1.0 and 0.5 in samples in which the value of ("length L3"–"length L2")/D was "0," "0.1," "0.2," "0.3," and "0.4." FIG. 11 shows the numbers of cycles reaching 50% oxide scale when the value of ("length L3"–"length L2")/D was variously changed in the range between 0 and 0.4 in samples in which the value of ("length L2"–"length L1") was "–0.75," "–0.5," "–0.25," "0," and "0.25."

As shown in FIG. 10, in the relationship between "length L1" and "length L2," the number of cycles when the oxide scale ratio exceeded 50% while the value of ("length L2"–"length L1") was in the range between "–0.75" and "0.25" exceeded 1000, so that satisfactory peel resistance was shown. The reason for this is considered that the center line L1 and the first curve L2 becomes comparatively proximal to each other and the flat surface 27*f* to which the noble metal tip 32 is welded is positioned at a portion where the residual stresses caused by bending are smaller, so that stable joint strength is obtained. On the other hand, it was found that when the value of ("length L2"–"length L1") was out of the above-described range, this deteriorated the peel resistance.

However, when the value of ("length L3"–"length L2")/D exceeded 0.3 (for example, was 0.4), even if the value of ("length L2"–"length L1") was in the above-described range, the peel resistance was deteriorated. This is also seen in the graph of FIG. 11. In other words, ("length L3"–"length L2")/D shows inclination of the joined surface of the noble metal tip 27 at the distal end portion of the ground electrode 27 to the horizontal plane, and if this value exceeds "0.3," there is a fear that this value will deteriorate the peel resistance.

Figure 12:
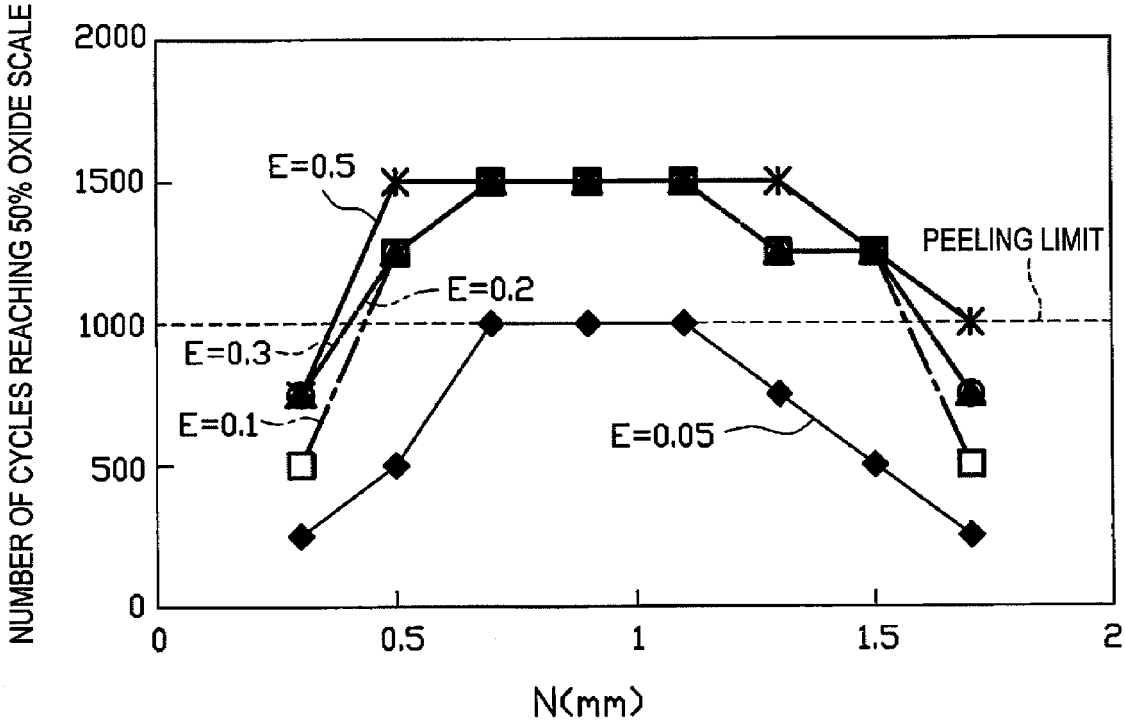
FIG. 12 is a graph showing the relationship of the number of cycles reaching 50% oxide scale to D corresponding to the distance to the contact surface to which the noble metal tip comes into contact when it is joined in samples in which the embedded amount E of the noble metal tip was variously changed.

Next, the numbers of cycles reaching 50% oxide scale of samples in which the embedded amount E (mm) of the noble metal tip 32 was "0.05," "0.1," "0.2," "0.3," and "0.5" when D (mm) corresponding to the distance between the ends of the contact surface of the inner peripheral surface which contacts the noble metal tip 32 when the noble metal tip was joined as viewed from a side surface of the ground electrode was variously changed between 0.3 mm and 1.7 mm, were evaluated. The results are shown in FIG. 12.

As shown in this figure, when the distance D satisfied $0.5 \leqq D \leqq 1.5$, the peel resistance became excellent. On the other hand, when D is smaller than 0.5 mm, the peel resistance is not sufficient. The reason for this is considered that a sufficient joint area cannot be secured. On the other hand, when D is more than 1.5 mm, the peel resistance is also not sufficient. The reason for this is considered that if D exceeds 1.5 mm, melting of the noble metal tip into the ground electrode hardly becomes uniform, and as a result, the welding strength becomes uneven.

It was found that when the embedded amount E (mm) of the noble metal tip satisfied $0.1 \leqq E \leqq 0.5$, the peel resistance became excellent. On the other hand, when E is smaller than 0.1 mm, the peel resistance is not sufficient. The reason for this is considered that the welding is not sufficient and satisfactory joint strength cannot be secured. Further, when E is more than 0.5 mm, the joint strength is improved, however, welding becomes difficult. Actuality, an attempt was made to manufacture a sample of E=0.6 mm, which proved difficult to manufacture. Even if it can be manufactured, when the noble metal tip is embedded at more than 0.5 mm, an excessive current is required to flow, and a melt solidification called dendrite is formed in the base metal of the ground electrode. Therefore, the oxidation resistance may be deteriorated due to the presence of the melt solidification.

Figure 13:
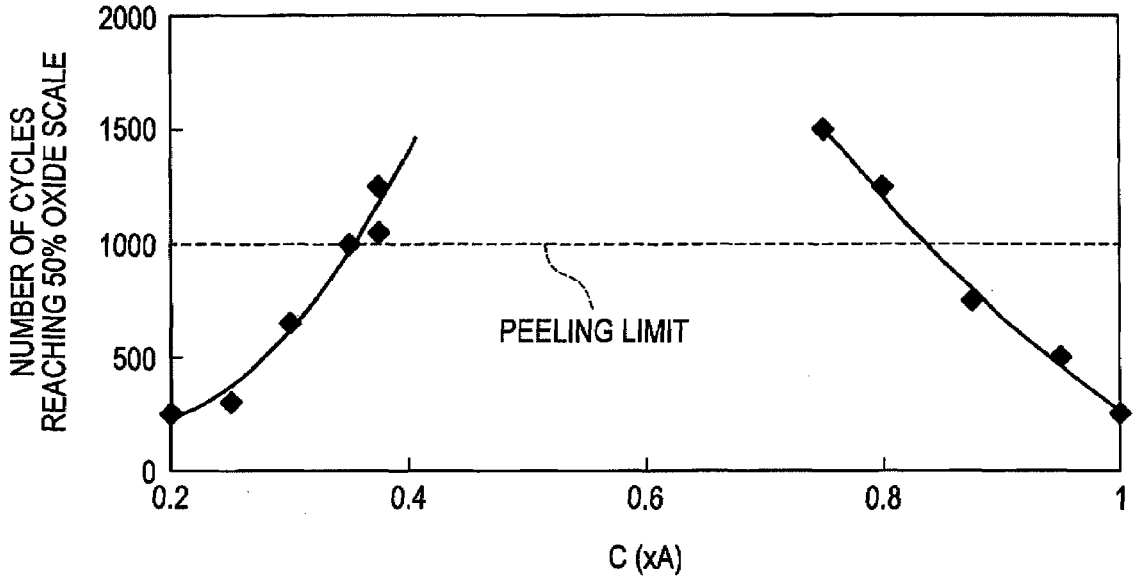
FIG. 13 is a graph showing the relationship of the number of cycles reaching 50% oxide scale to the ratio of the thickness C of the distal end surface to the thickness A of a general portion.

Next, the numbers of cycles reaching 50% oxide scale in samples in which the thickness C (mm) of the distal end surface of the ground electrode was variously changed were evaluated. The results are shown in FIG. 13. As shown in this figure, it was found that by satisfying $0.30 \times A \leqq C \leqq 0.95 \times A$, the number of cycles reaching 50% oxide scale exceeded 500. Particularly, it was found that by satisfying $0.35 \times A \leqq C \leqq 0.80 \times A$ or $0.40 \times A \leqq C \leqq 0.80 \times A$, the number of cycles reaching 50% oxide scale exceeded 1000. On the other hand, when C was less than $0.30 \times A$ or over $0.95 \times A$, the number of cycles reaching 50% oxide scale was less than 500. The reason for this is considered that the joined portion of the noble metal tip is positioned at a portion where the residual stresses caused by bending are larger.

Figure 14:
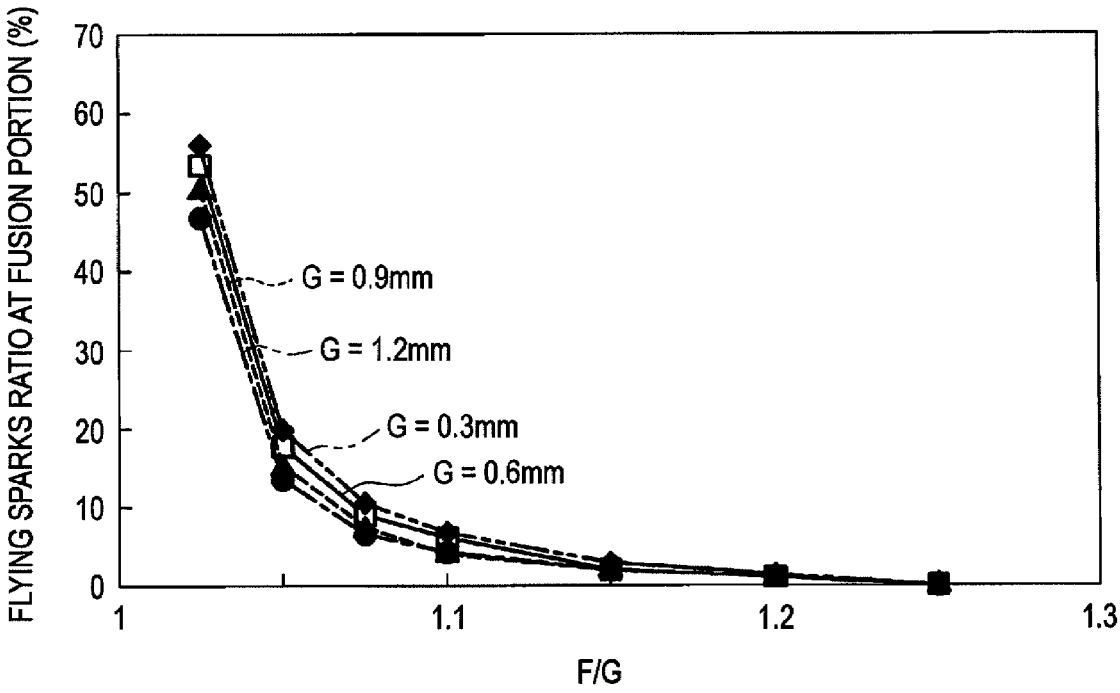
FIG. 14 is a graph sowing the relationship of the flying sparks ratio between the molten bond and the noble metal tip to F/G.

Subsequently, in spark plug samples in which the ratio of the shortest distance F (mm) between the noble metal tip 32 and the molten bond 41 to the shortest distance G (mm) of the spark discharge gap 33, that is, F/G was variously changed, the flying sparks ratio between the molten bond and the noble metal tip was evaluated. In detail, the spark plug samples were attached to the inside of a predetermined pressurized chamber (pressure: 0.4 MPa, the atmospheric atmosphere), and by visually observing images when sparking, flying sparks ratios were calculated. The results are shown in FIG. 14.

As shown in this figure, when F/G is "1.05" or more, the flying sparks ratio between the molten bond and the noble metal tip is remarkably small, that is, normal spark discharge is performed. On the other hand, it was found that when F/G is less than "1.05," the flying sparks ratio between the molten bond and the noble metal tip greatly increased. From these results, to avoid flying sparks at the molten bond, it is preferable that F/G is set to "1.05" or more.

Second Embodiment

Next, a second embodiment will be described with reference to FIG. 15 to FIG. 19. However, this second embodiment has features of a method of producing a spark plug, so that hereinafter, the method of producing a spark plug, in particular, differences from the above-described first embodiment will be mainly described.

In the first embodiment, after the noble metal tip 32 is welded to the inner peripheral surface of the distal end portion (thin portion 272) of the straight rod-shaped ground electrode 27 joined to the leading end portion of the metal shell 3, the insulator 2 having the center electrode 5 and the metal shell 3 are fitted to each other. Thereafter, by bending the ground electrode 27, the spark plug 1 is obtained.

Figure 15:
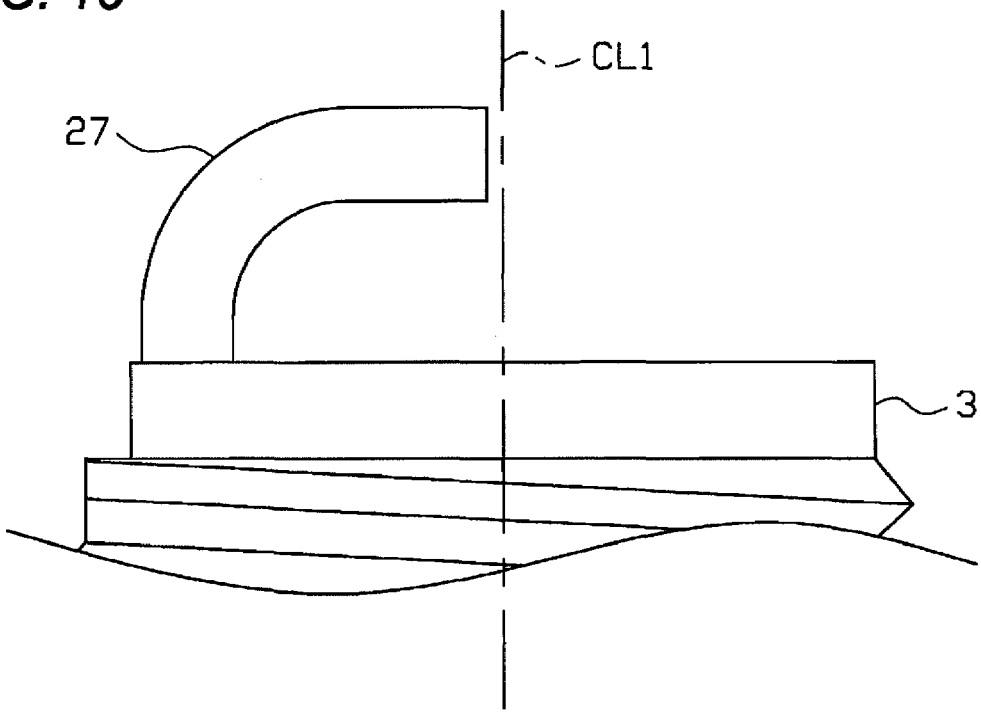
FIG. 15 is an enlarged front view showing the ground electrode, etc., for describing the method of producing a spark plug of the second embodiment.

On the other hand, in the present second embodiment, first, as shown in FIG. 15, before the insulator 2 and the metal shell 3 are fitted to each other, the straight rod-shaped ground electrode 27 joined to the leading end portion of the metal shell 3 is bent toward the axis line CL1. This straight rod-shaped ground electrode 27 is slightly longer than the ground electrode 27 of the first embodiment. Accordingly, the ground electrode 27 can be more reliably bent, and therefore, the distal end portion of the ground electrode 27 can be more reliably made straight.

Figure 16:
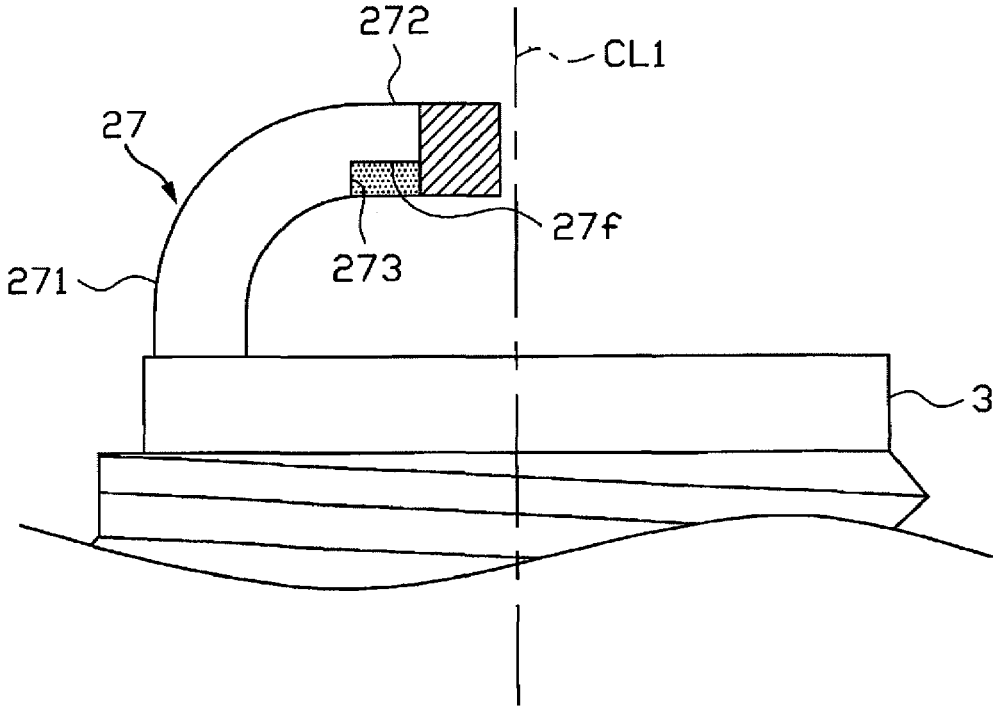
FIG. 16 is an enlarged front view showing the ground electrode, etc., for describing the method of producing a spark plug of the second embodiment.

Next, as shown in FIG. 16, the distal end portion (shaded portion in this figure) of the ground electrode 27 is cut and the inner portion (portion with dots in this figure) of the distal end portion of the cut ground electrode 27 is notched in a hook shape by cutting or pressing to form the flat surface 27*f* (thin portion 272 and stepped portion 273). It is also allowed that after the flat surface 27*f* is formed by pressing the distal end portion of the ground electrode 27, the distal end portion of the ground electrode 27 is cut.

Figure 17:
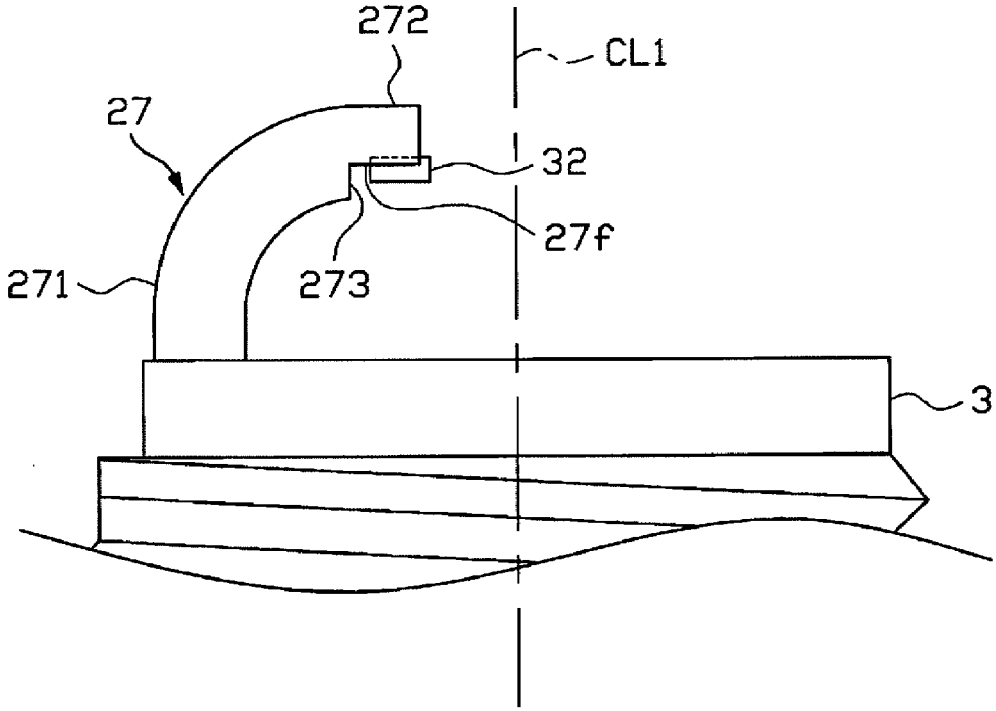
FIG. 17 is an enlarged front view showing the noble metal tip, etc., for describing the method of producing a spark plug of the second embodiment.

Next, as shown in FIG. 17, resistance welding is applied while the noble metal tip 32 is pressed against the flat surface 27*f* of the ground electrode 27 to join the noble metal tip 32 to the ground electrode 27.

Figure 18:
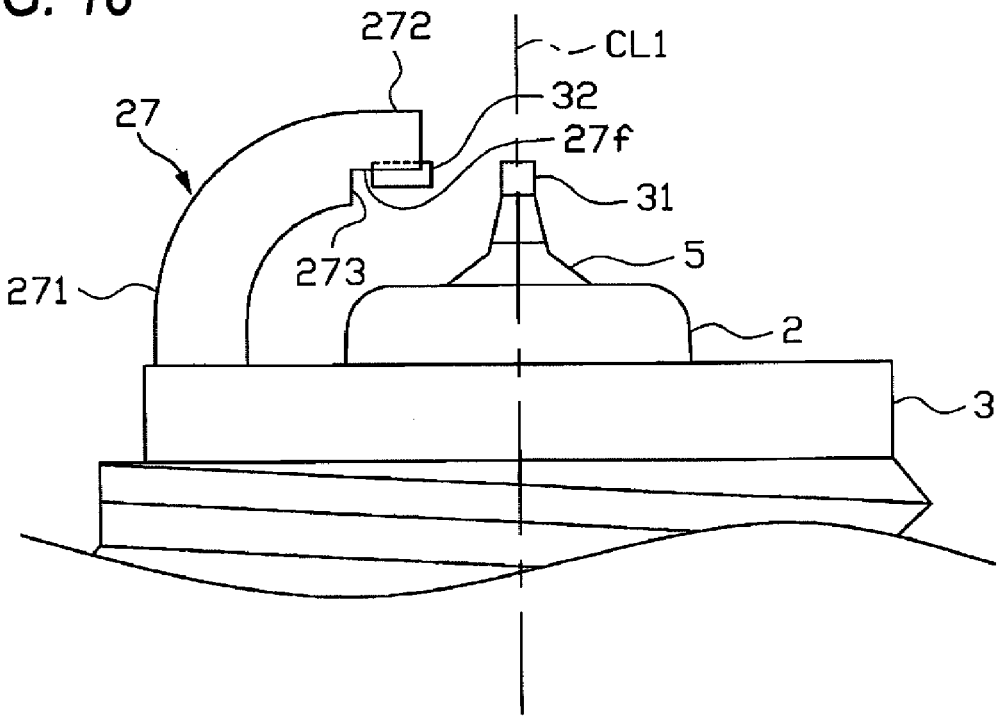
FIG. 18 is an enlarged front view showing the insulator 2, etc., for describing the method of producing a spark plug of the second embodiment.

Then, as shown in FIG. 18, by fitting the metal shell 3 having the ground electrode 27 and the insulator 2 having the center electrode 5, etc., to each other, the spark plug 1 is obtained. After fitting the metal shell 3 and the insulator 2 to each other, the ground electrode 27 may be slightly bent to finely adjust the size of the spark discharge gap 33 (in this case, bending stresses are applied to the ground electrode 27, however, the bending stresses are extremely small, so that this does not deteriorate the peel resistance of the noble metal tip 32).

As described in detail above, according to the second embodiment, application of the bending stresses of the ground electrode 27 caused by bending to the noble metal tip 32 can be suppressed. As a result, the peel resistance of the noble metal tip 32 can be further improved.

Additionally, the noble metal tip 32 is joined to the flat surface 27*f* formed on the inner peripheral surface of the distal end portion (thin portion 272) of the ground electrode 27, so that the noble metal tip 32 can be comparatively easily joined to the ground electrode 27. As a result, the joint strength of the noble metal tip 32 can be further improved, and the peel resistance of the noble metal tip 32 can be further improved.

After the noble metal tip 32 is joined, the metal shell 3 and the insulator 2 are fitted to each other, so that a sufficient space for joining the noble metal tip 32 to the ground electrode 27 can be secured. As a result, operability can be greatly improved. Further, the noble metal tip 32 can be more reliably and accurately joined to the ground electrode 27, and therefore, the joint strength can be further improved.

Next, to confirm the operation and effect obtained by the production method of the present embodiment, for a spark plug sample 1 produced according to the production method of the first embodiment (the ground electrode was bent after the noble metal tip was joined), and a spark plug sample 2 produced according to the production method of the second embodiment (after the ground electrode was bent, the noble metal tip was joined), the above-described desk burner valuation test was carried out and the numbers of cycles reaching 50% oxide scale were measured. The test results are shown in FIG. 19.

Figure 19:
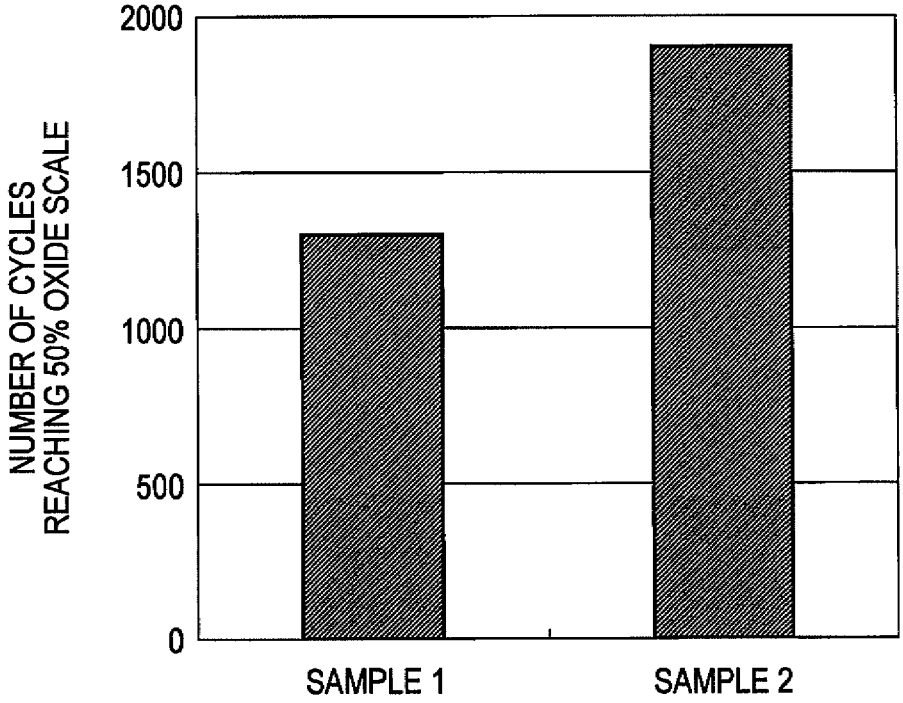
FIG. 19 is a graph showing the numbers of cycles reaching 50% oxide scale in samples produced according to different production methods.

As shown in FIG. 19, it was proved that the number of cycles reaching 50% oxide scale exceeded 1000 and the spark plug had excellent peel resistance in both samples. Particularly, in sample 2, it was proved the number of cycles reaching 50% oxide scale was 1500 or more, so that the spark plug had extremely excellent peel resistance. The reason for this is considered that application of the bending stresses of the ground electrode caused by bending to the noble metal tip could be prevented.

The present invention is not limited to the above described embodiment, and the following modified examples may be applicable thereto.

(a) In the above embodiment, the noble metal tip 32 is embodied in the case where it is joined to the ground electrode 27 by means of resistance welding, however, it is not limited to the resistance welding. Therefore, the noble metal tip may be joined by laser welding or electron beam welding.

(b) In the above embodiment, a spark plug provided with one ground electrode 27 is illustrated, however, the present invention can be embodied in a spark plug having two or more ground electrodes.

(c) In the above-described embodiment, a ground electrode 27 which has a substantially rectangular sectional shape is used, however, it is also allowed that its back surface side is curved or it has a trapezoidal sectional shape.

(d) In the above embodiment, the case where the noble metal tip 31 is joined by welding to the leading end of the main body of the center electrode 5 is embodied, however, this noble metal tip 31 for the center electrode may be omitted. In this case, the main body forms the center electrode 5.

(e) In the above embodiment, for convenience of description, the ground electrode 27 is described as having a simple two-layer structure. However, the ground electrode 27*b* may have a three-layer structure or a multi-layer structure including four or more layers. It is preferable that a layer on the inner side of the external layer 27B contains a metal having greater excellent thermal conductivity than the external layer 27B. For example, on the inner side of the external layer 27B, an intermediate layer made of a copper alloy or pure copper may be provided, and an innermost layer made of pure nickel may be provided on the inner side of the intermediate layer. A ground electrode 27 having only a single nickel layer may also be used instead of the multi-layer structure.

Figure 20:
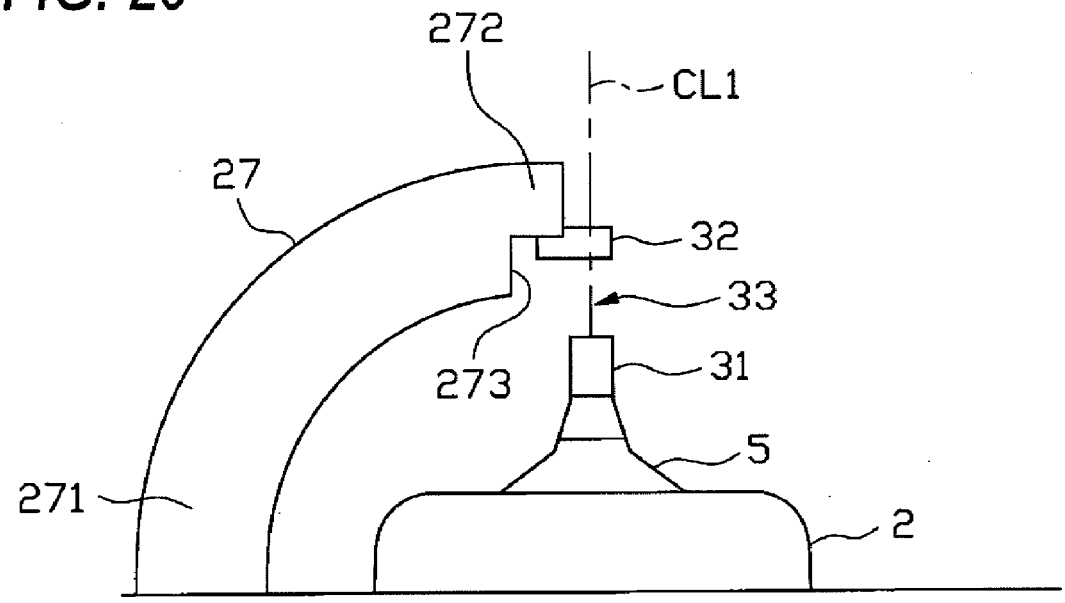
FIG. 20 is a schematic side view showing a major portion of a spark plug of another embodiment in an enlarged manner.

(f) In the above embodiment, the noble metal tip 32 protrudes toward the axis line CL1 from the distal end surface 27*s* of the ground electrode 27, and the spark discharge gap 33 is formed between the outer periphery of the noble metal tip 31 for the center electrode and the noble metal tip 32. In other words, in the above embodiment, the spark discharge is performed substantially along the direction perpendicular to the direction of the axis line CL1 (i.e., laterally). On the other hand, as shown in FIG. 20, the end face of the noble metal tip 32 in the direction of the axis line CL1 (lower end face in the figure) may be disposed to face the leading end surface of the noble metal tip 31 for the center electrode (or the leading end surface of the center electrode 5). In other words, the present invention may be embodied in a spark plug in which the spark discharge is performed substantially along the direction of the axis line CL1.

Figure 21:
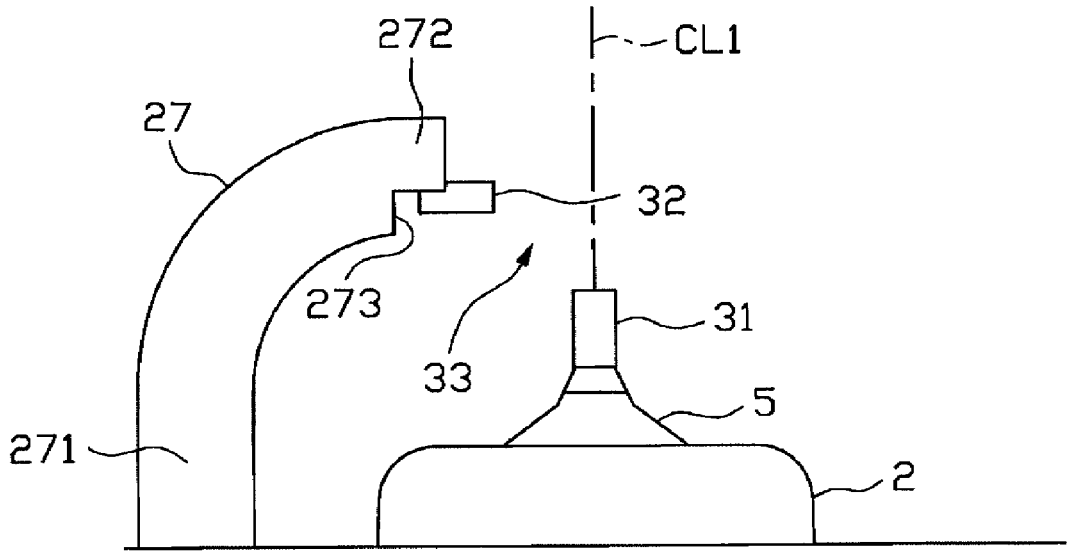
FIG. 21 is a schematic side view showing a major portion of a spark plug of another embodiment in an enlarged manner.

As shown in FIG. 21, the protruding end surface in the protruding direction of the noble metal tip 32 may also be disposed to face a part of the axis line CL1 located on the leading end side farther than the noble metal tip 31 for the center electrode. In other words, the present invention may be embodied in a spark plug in which the spark discharge is performed diagonally with respect to the direction of the axis line CL1.

(g) In the above embodiment, the relationship between the depth of the stepped portion 273 and the thickness of the noble metal tip 32 is not especially mentioned, however, it is more preferable that the depth of the stepped portion 273 is larger than the thickness of the noble metal tip 32. Accordingly, the thin portion 272 becomes thinner, and the residual stresses caused by bending at the thin portion 272 can be made smaller.

(h) If the thin portion 272 is excessively long, the advantages obtained by providing the thick portion 271 and the thin portion 272 may be reduced although this is not especially mentioned in the above-described embodiment. In such a perspective, the length from the distal end surface 27*s* of the ground electrode 27 to the stepped portion 273 (length of the thin portion 272) is preferably 1.2 (mm) or less.

This application is based on Japanese Patent Application No. 2007-300824 filed Nov. 20, 2007, Japanese Patent application No. 2007-338712 filed on Dec. 28, 2007, and Japanese Patent application No. 2008-120065 filed on May 2, 2008, the above applications incorporated herein by reference in their entirety.

TRANSLATION OF DRAWINGS

FIG. 7A
Ground electrode

Figure 7B:
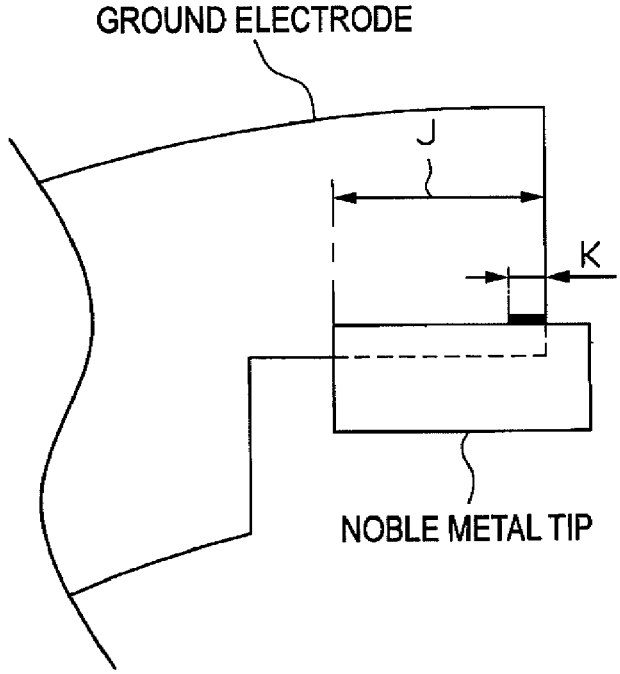

Noble metal tip
FIG. 7B
Ground electrode
Noble metal tip
FIG. 8
(a) Number of cycles reaching 50% oxide scale
(b) Distal end straight length ST (mm)
(c) Peeling limit
FIG. 9
(a) Endurance time (Hr)
(b) Breaking strength limit
FIG. 10
(a) Number of cycles reaching 50% oxide scale
(b) length L2−length L1 (mm)
(c) (length L3−length L2)/D=0
(d) (length L3−length L2)/D=0.1
(f) (length L3−length L2)/D=0.3
(h) Peel-off limit
(e) (length L3−length L2)/D=0.2
(g) (length L3−length L2)/D=0.4
FIG. 11
(a) Number of cycles reaching 50% oxide scale
(b) (length L3−length L2)/D
(c) length L2−length L1=−0.75
(d) length L2−length L1=−0.50
(e) length L2−length L1=−0.25
(f) length L2−length L1=0
(g) length L2−length L1=0.25
(h) Peeling limit
FIG. 12
(a) Number of cycles reaching 50% oxide scale
(b) Peeling limit
FIG. 13
(a) Number of cycles reaching 50% oxide scale
(b) Peeling limit
FIG. 14
(a) Flying sparks ratio at fusion portion

What is claimed is:

1. A spark plug for an internal combustion engine, said spark plug comprising:

a rod-shaped center electrode extending in the direction of an axis line;

a substantially cylindrical insulator provided on an outer periphery of the center electrode;

a cylindrical metal shell provided on an outer periphery of the insulator;

a ground electrode having a base end joined to a leading end portion of the metal shell and a distal end bent toward the axis line, the ground electrode comprising:

a thick portion provided on a base end side, a thin portion provided on a distal end side, and a stepped portion provided on an inner peripheral surface between the thick portion and the thin portion; and a first noble metal tip joined to and partially embedded in the inner peripheral surface of the thin portion, the first noble metal tip being disposed to form a gap between the first noble metal tip and the leading end portion of the center electrode, wherein a relationship $B/A \leqq 2.5$ is satisfied where, when viewed from a side surface of the ground electrode, A (mm) is a thickness of the thick portion of the ground electrode, and B (mm) is a distance between the base end of the inner peripheral surface of the ground electrode and a distal end surface of the ground electrode in the horizontal direction.

2. The spark plug according to claim 1, wherein the center electrode includes a second noble metal tip welded to a leading end of a main body of the center electrode, wherein the main body of the center electrode and the second noble metal tip are joined to each other via a molten bond in which metal components contained in the main body of the center electrode and the second noble metal tip are melted together, wherein the gap is provided between an outer peripheral surface of the second noble metal tip and the first noble metal tip, and wherein a relationship $F \geqq 1.05 \times G$ is satisfied, where:

F (mm) is a shortest distance between the first noble metal tip and the molten bond, and G (mm) is a shortest distance of the gap.

3. The spark plug according to claim 1, wherein the stepped portion and the thin portion are formed by cutting or pressing the distal end portion of the rod-shaped ground electrode, thereafter welding the first noble metal tip to the ground electrode, and thereafter bending the ground electrode.

4. The spark plug according to claim 1, wherein the first noble metal tip has a prism shape.

5. The spark plug according to claim 1, wherein a depth of the stepped portion is larger than the thickness of a first noble metal tip.

6. The spark plug according to claim 1, wherein the first noble metal tip protrudes from the distal end surface of the ground electrode, and wherein a protruding end surface of the first noble metal tip in the protruding direction is disposed to face the leading end portion of the center electrode to perform a spark discharge substantially along a direction perpendicular to the direction of the axis line.

7. The spark plug according to claim 1, wherein the first noble metal tip protrudes from the distal end surface of the ground electrode, and wherein an end surface of the first noble metal tip located at an end in the direction of the axis line is disposed to face the leading end portion of the center electrode to perform a spark discharge substantially along the direction of the axis line.

8. The spark plug according to claim 1, wherein the first noble metal tip protrudes from the distal end surface of the ground electrode, and wherein the protruding end surface of the first noble metal tip in the protruding direction is disposed to face a part of the axis line which is positioned in the leading end side farther than the center electrode to perform a spark discharge diagonally with respect to the direction of the axis line.

9. The spark plug according to claim 1, wherein the inner peripheral surface of the thin portion of the ground electrode has a flat surface perpendicular to the direction of the axis line.

10. A method for producing a spark plug, said spark plug comprising:

a rod-shaped center electrode extending in the direction of an axis line;

a substantially cylindrical insulator provided on an outer periphery of the center electrode;

a cylindrical metal shell provided on an outer periphery of the insulator;

a ground electrode having a base end joined to a leading end portion of the metal shell and a distal end bent toward the axis line, the ground electrode comprising: a thick portion provided on a base end side, a thin portion provided on a distal end side, and a stepped portion provided on an inner peripheral surface between the thick portion and the thin portion;

a noble metal tip joined to and partially embedded in the inner peripheral surface of a distal end portion of the ground electrode, the noble metal tip being disposed to form a gap between the noble metal tip and the leading end portion of the center electrode, said method comprising:

bending the ground electrode toward the axis line; and joining the noble metal tip to the inner peripheral surface of the distal end portion of the ground electrode, wherein after bending the ground electrode toward the axis line, the noble metal tip is joined to the inner peripheral surface of the distal end portion of the ground electrode.

11. The method according to claim 10, comprising:

flattening the inner peripheral surface of the distal end portion of the ground electrode, wherein after bending the ground electrode toward the axis line but before joining the noble metal tip) to the inner peripheral surface of the distal end portion of the ground electrode, the inner peripheral surface of the distal end portion of the ground electrode is flattened.

12. The method according to claim 10, comprising:

fitting the metal shell having the ground electrode joined to the distal end portion thereof to the insulator having the center electrode attached thereto, wherein after joining the noble metal tip to the inner peripheral surface of the leading end portion of the ground electrode, the metal shell and the insulator are fitted to each other.

13. A spark plug for an internal combustion engine, said spark plug comprising:

a rod-shaped center electrode extending in the direction of an axis line;

a substantially cylindrical insulator provided on an outer periphery of the center electrode;

a cylindrical metal shell provided on an outer periphery of the insulator;

a ground electrode having a base end joined to a leading end portion of the metal shell and a distal end bent toward the axis line, the ground electrode comprising:

a thick portion provided on a base end side, a thin portion provided on a distal end side, and a stepped portion provided on an inner peripheral surface between the thick portion and the thin portion; and a first noble metal tip joined to and partially embedded in the inner peripheral surface of the thin portion, the first noble metal tip being disposed to form a gap between the first noble metal tip and the leading end portion of the center electrode, wherein a relationship $-0.750 \leqq$ "length L2"−"length L1" $\leqq 0.250$ is satisfied where, when viewed from a side surface of the ground electrode, A (mm) is a thickness of the thick portion of the ground electrode;

L1 is a center line which is a curve shifted by [A/2] to the inner peripheral side from an outer peripheral line of the ground electrode;

a first point "a" is an intersection of the center line Ll and distal end surface of the ground electrode;

a second point "b" is an intersection of the center line Ll and a plane including the distal end surface of the metal shell;

"length L1" (mm) is a length between the first point "a" and the second point "b" of the center line L1;

C (mm) is a thickness of the distal end surface;

a first curve L2 is a curve shifted by [C−A/2] to the inner peripheral side from the center line L1;

a third point "c" is an intersection of the first curve L2 and the distal end surface;

a fourth point "d" is an intersection between the first curve L2 and a plane including a leading end surface of the metal shell; and "length L2" (mm) is a length between the third point "c" and the fourth point "d" of the first curve L2.

14. The spark plug according to claim 13, wherein the first noble metal tip protrudes from the distal end surface of the ground electrode, and wherein following relationships are satisfied:

$$0.5 \leqq D \leqq 1.5;$$

$$0.1 \leqq E \leqq 0.5; \text{ and}$$

$$(\text{"length } L3\text{"} - \text{"length } L2\text{"})/D\ 0.30$$

where, when viewed from a side surface of the ground electrode, a fifth point "e" is an intersection of: the base end surface of the first noble metal tip located on an opposite side of a protruding end surface of the first noble metal tip; and the inner peripheral surface of the thin portion;

a second curve L3 is a curve shifted from the center line L1 and passing through the fifth point "e";

a sixth point "f" is an intersection of the second curve L3 and the distal end surface of the ground electrode;

a seventh point "g" is an intersection of the second curve L3 and the plane including the leading end surface of the metal shell; "length L3" (mm) is a length between the sixth point "f" and the seventh point "g" of the second curve L3;

D (mm) is a distance between the distal end surface and the fifth point "e"; and E (mm) is an amount of an embedded portion of the first noble metal tip from the inner peripheral surface of the thin portion.

15. The spark plug according to claim 13, wherein a relationship $0.30 \times A \leqq C \leqq 0.95 \times A$ is satisfied.

16. The spark plug according to claim 13, wherein $0.40 \times A \leqq C \leqq 0.80 \times A$ is satisfied.

17. The spark plug according to claim 13, wherein the center electrode includes a second noble metal tip welded to a leading end of a main body of the center electrode, wherein the main body of the center electrode and the second noble metal tip are joined to each other via a molten bond in which metal components contained in the main body of the center electrode and the second noble metal tip are melted together, wherein the gap is provided between an outer peripheral surface of the second noble metal tip and the first noble metal tip, and wherein a relationship $F \geqq 1.05 \times G$ is satisfied, where:

F (mm) is a shortest distance between the first noble metal tip and the molten bond, and G (mm) is a shortest distance of the gap.

18. The spark plug according to claim 13, wherein the stepped portion and the thin portion are formed by cutting or pressing the distal end portion of the rod-shaped ground electrode, thereafter welding the first noble metal tip to the ground electrode, and thereafter bending the ground electrode.

19. The spark plug according to claim 13, wherein the first noble metal tip has a prism shape.

20. The spark plug according to claim 13, wherein a depth of the stepped portion is larger than the thickness of a first noble metal tip.

21. The spark plug according to claim 13, wherein the first noble metal tip protrudes from the distal end surface of the ground electrode, and wherein a protruding end surface of the first noble metal tip in the protruding direction is disposed to face the leading end portion of the center electrode to perform a spark discharge substantially along a direction perpendicular to the direction of the axis line.

* * * * *